US006442880B1

(12) United States Patent
Allan

(10) Patent No.: US 6,442,880 B1
(45) Date of Patent: Sep. 3, 2002

(54) FIREARM WITH LOCKING AND UNLOCKING APPARATUS

(76) Inventor: Robert M. Allan, 1731 Colgate Cir., La Jolla, CA (US) 92037

( * ) Notice: Subject to any disclaimer, the term of this patent is extended or adjusted under 35 U.S.C. 154(b) by 0 days.

(21) Appl. No.: 09/354,427

(22) Filed: Jul. 16, 1999

Related U.S. Application Data

(60) Provisional application No. 60/094,954, filed on Jul. 31, 1998, now abandoned.

(51) Int. Cl.[7] ..... F41A 17/06

(52) U.S. Cl. ..... 42/70.08; 42/70.01; 42/70.06; 42/70.11; 42/66

(58) Field of Search ..... 89/148; 42/70.01, 42/70.06, 70.08, 70.11, 66

(56) References Cited

U.S. PATENT DOCUMENTS

| | | | | | |
|---|---|---|---|---|---|
| 3,735,519 | A | | 5/1973 | Fox | |
| 4,003,152 | A | * | 1/1977 | Barker et al. | 42/70.08 |
| 4,457,091 | A | | 7/1984 | Wallerstein | |
| 4,467,545 | A | * | 8/1984 | Shaw, Jr. | 42/70.11 |
| 4,563,827 | A | | 1/1986 | Heltzel | |
| 4,763,431 | A | * | 8/1988 | Allan et al. | 42/70.11 |
| 4,987,693 | A | | 1/1991 | Brooks | 42/70.11 |
| 5,016,376 | A | | 5/1991 | Pugh | 42/70.11 |
| 5,016,378 | A | | 5/1991 | Sain | 42/70.06 |
| 5,022,175 | A | * | 6/1991 | Oncke et al. | 42/70.08 |
| 5,090,148 | A | | 2/1992 | Brooks | 42/70.11 |
| 5,123,193 | A | | 6/1992 | Pugh | 42/70.11 |
| 5,179,235 | A | | 1/1993 | Toole | 42/103 |
| 5,229,532 | A | | 7/1993 | Brooks | 42/70.11 |
| 5,408,777 | A | | 4/1995 | Brooks | 42/70.11 |
| 5,435,091 | A | | 7/1995 | Toole et al. | 42/103 |
| 5,448,847 | A | * | 9/1995 | Teetzel | 42/70.11 |
| 5,502,915 | A | | 4/1996 | Mendelsohn et al. | |
| 5,603,179 | A | | 2/1997 | Adams | |
| 5,704,153 | A | | 1/1998 | Kaminski et al. | 42/70.11 |
| 5,732,497 | A | | 3/1998 | Brooks | 42/70.11 |
| 5,749,166 | A | | 5/1998 | Brooks | 42/70.11 |
| 5,782,029 | A | | 7/1998 | Brooks | 42/70.11 |
| 5,867,930 | A | | 2/1999 | Kaminski et al. | 42/70.11 |
| 5,915,936 | A | | 6/1999 | Brentzel | |

OTHER PUBLICATIONS

Weiss, D. R., "Smart Gun Technology Project Final Report", Feb., 1996, 160 pages.

* cited by examiner

*Primary Examiner*—Stephen M. Johnson
(74) *Attorney, Agent, or Firm*—William W. Haefliger

(57) ABSTRACT

A firearm including a body, barrel, trigger, trigger guard and firing pin, including a mechanism configured to operate the firing pin, and a safety mechanism including electronic circuitry and push buttons to operate the electronic circuitry and associated timing device including automatic time delay re-locking, the firearm also having a blocker that is controlled by an electromechanical device operated by electronic circuitry to prevent movement of the mechanism.

11 Claims, 19 Drawing Sheets

FIG. 5.
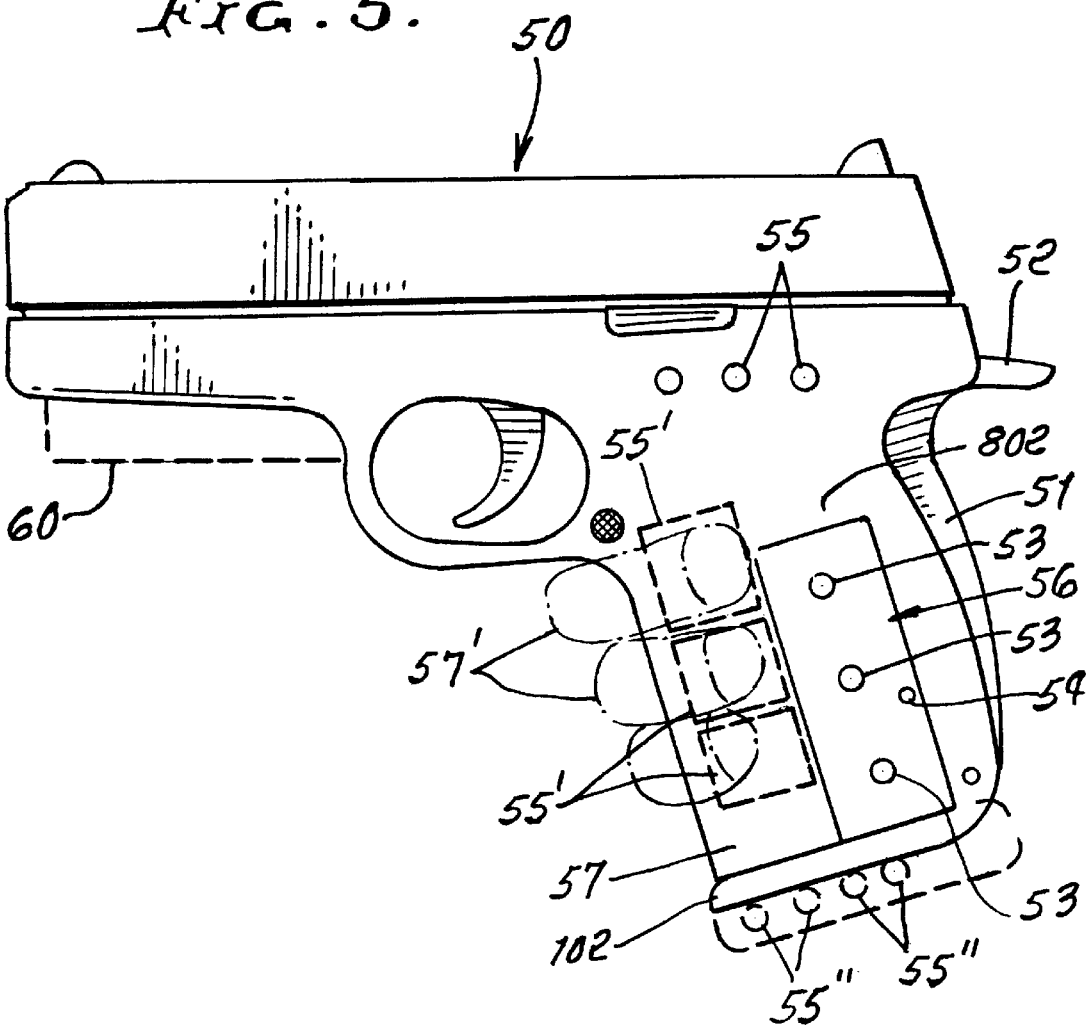
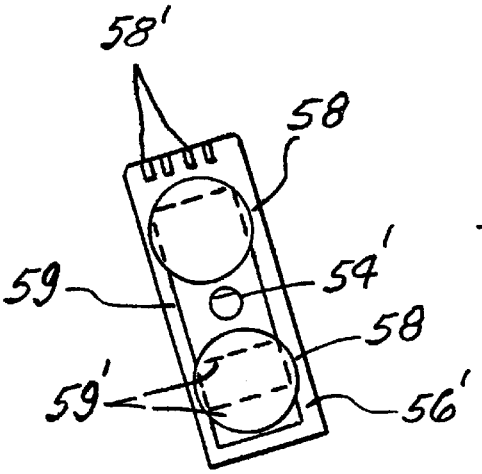
FIG. 6.

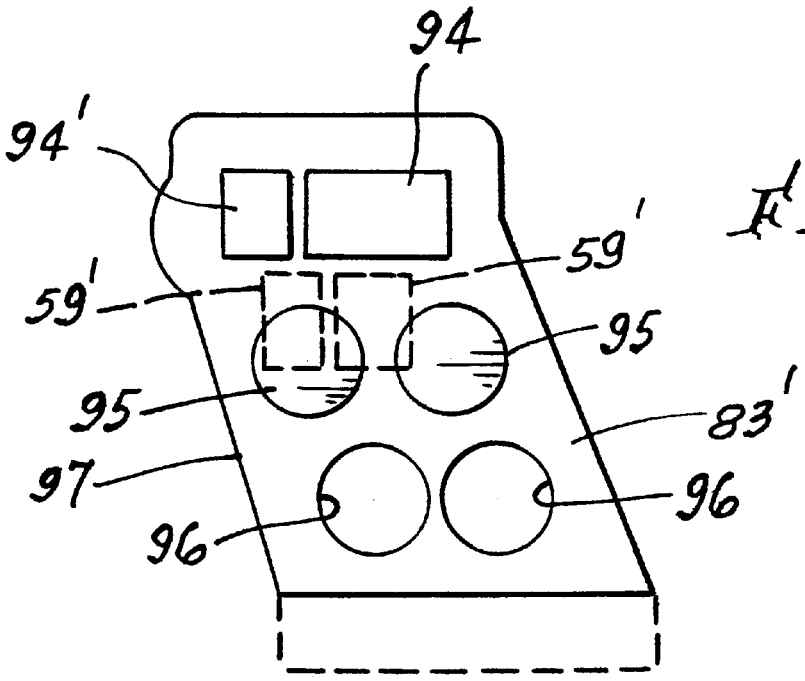
FIG. 10.
FIG. 10a.
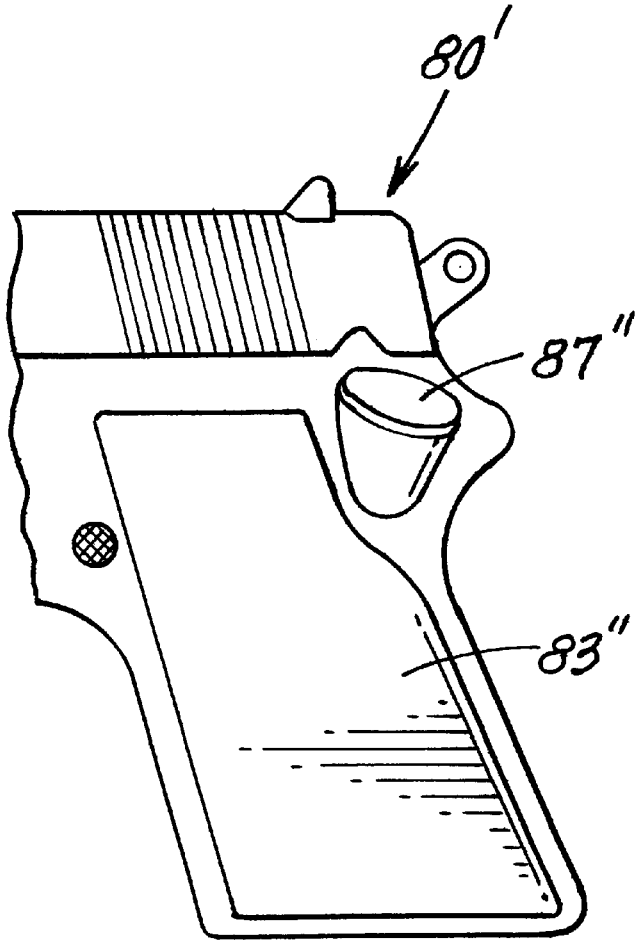

FIREARM WITH LOCKING AND UNLOCKING APPARATUS

This application claims priority from provisional application Serial No. 60/094,954, filed Jul. 31, 1998 now abondoned.

BACKGROUND OF THE INVENTION

This invention relates generally to firearms with locking devices which automatically re-lock the firearm. More particularly, it concerns control of such devices. Such control typically comprises electronic circuitry, one example being a microprocessor.

Sandia National Laboratories Smart Gun Technology Project final report, February, 1996 listed multiple technologies for firearm locking and unlocking. The report was commissioned because of the perceived need to protect police officers against their own guns in take-away situations. Firearms with the highest ranked automatic re-locking technologies or mechanisms included those with radio frequency, magnetic ring control, and finger print recognition. Firearms which automatically re-lock after a grip is released, such as U.S. Pat. No. 4,763,431 to Allan et al, were not evaluated. Firearms that automatically relock due to timing mechanism were not mentioned.

Locking devices built into firearms typically are intended to prevent accidental or unauthorized firing, as by a child or others. Firearm manufacturers and gun safety experts commonly recommend that guns be locked and separated from ammunition. In spite of these recommendations, it is believed that many guns are purchased for personal defense at the home, and kept loaded in a convenient place, potentially accessible by children and other unauthorized parties. Firearm safety devices, such as trigger locks may be added to firearms after purchase to prevent unauthorized use. A recent survey indicated nearly 7 million American households keep at least one unlocked, loaded gun in the home.

A loaded firearm maintained in the home with a trigger lock preventing unauthorized use that creates several problems. A quick response is questionable since a key typically must be located and inserted into the lock, possibly in the dark. The safety offered by a conventional trigger lock is questionable to the user, who wants quick response as well as prevention of unauthorized use.

A child who can locate a locked gun, likely can also locate a hidden key. If instead of a key a combination trigger lock is used, a flashlight and or eyeglasses may be needed, thus slowing a quick response and reducing the number of people willing to use this type of lock. Alternatively, a push button mechanical combination lock may be permanently added to gun. Potentially a gun thus equipped could be operated in the dark by feel, which is an advantage over conventional trigger locks. Such devices, however, have several drawbacks. For example, a gun with a sophisticated looking locking device that doesn't automatically re-lock itself is potentially more dangerous to a child or to an unauthorized person than a gun without locking capability. This is because a gun with a sophisticated looking locking device may be assumed to be locked when it isn't. Moreover, a simple mechanical lock's push button combination on a gun may be relatively easy to break, because mechanical locks have no lock-out capability for repeated incorrect tries, and there is no requirement that push buttons be pushed in order. Thus through experimentation a great number of simple combinations could be tried by a curious child.

U.S. Pat. No. 4,763,431 to Allan disclosed mechanism to overcome the automatic re-locking problem for handguns typically kept in the home for defense. Allan disclosed a pressure-sensitive safety-grip bar which automatically put the gun back in safety mode if dropped, put down, or taken away by force. There is need, as during law enforcement, hunting and target shooting, to overcome the impracticality of locking the firearm every time the gun in put down. For safety, there is a need for firearms to be locked automatically after use, so that the owner, family members and society may be secure in the knowledge that the firearm has not inadvertently been left unlocked.

Certain guns have manual safeties which are used by experienced gun owners to prevent accidental discharge; however, they are faulty if used to prevent accidents by children and unauthorized individuals, because anyone can switch the safety to "OFF". Other popular guns have no manual safeties. There is need for guns which can be enabled in less than two seconds by an owner, and having safeties which automatically switch "ON" and which cannot be switched "OFF" by children, or unauthorized individuals. Further, devices having solenoids for blocking trigger mechanisms or for preventing hammer movement, typically are faulty and lack the unusual combinations or features, functions and results as are now afforded by the present invention, and which uniquely meets the needs of the user and society, as will appear.

SUMMARY OF THE INVENTION

It is a major object of the invention to provide solutions to the user's and society's needs, as referred to. For example, it is a purpose of the invention to provide for an improved firearm for its owner, the owner's family, and society. The invention provides an improved gun meeting one or more of the following objectives:

1. To provide a firearm that automatically re-locks itself if dropped or taken away, so as to prevent the firearm being used against the owner;
2. To provide a firearm that can be quickly and reliably unlocked for a reasonable period of use, for example for ten hours for law enforcement or hunting, and which then automatically re-locks itself;
3. To provide a firearm with motor assisted, electronic circuitry controlled, automatic re-locking;
4. To provide a firearm with an improved ergonomic construction-pressure sensitive safety, having a minimum of two positions for user determination, by feel, whether the safety is extended in the safety-ON mode, or in the retracted safety-OFF mode, so that the user does not need to determine, visually, the firearm safety's status;
5. To provide a firearm trigger lock mechanism that prevents the trigger from being pulled from its forward position, as for firearms with push button combination locks, hand characteristic scanning or other personalized gun safety technologies;
6. To provide a firearm hammer block mechanism that prevents the hammer from firing the gun, when the firearm's safety is in its ON position, for firearms with push button combination locks, hand characteristic scanning, or other personalized gun safety technologies;
7. To provide a firearm transfer bar mechanism that prevents the hammer from firing the gun when the firearm's safety is in its ON position, for firearms with push button combination locks, hand characteristic scanning, or other personalized gun safety technologies;

8. To provide a firearm with a motor positioned safety, which is connected to one or more of the following:
   i) a trigger lock
   ii) a hammer block
   iii) a transfer bar
   iv) a gun cable lock.
9. To provide a firearm with an easy to use, push-button electronic circuitry controlled combination lock, for quick and reliable use;
10. To provide a firearm with internal electronic circuitry operated safety locking, including a pressure sensitive safety, which can be used both to operate a laser sight and unlock the firearm when a safety part is retracted;
11. To provide a semi-automatic handgun with a module containing one or more of the following: push buttons, a electronic circuitry batteries, a motor, a mechanism to prevent handgun from firing.
12. To provide a firearm with a combination lock, where repeated incorrect entries will temporarily lock the locking mechanism;
13. To provide a firearm where incorrect combination lock entries are counted and reported for presentation to the firearm owner;
14. To provide firearm trigger lock and hammer block or transfer bar mechanisms, and a electronic circuitry with hand characteristic scanning capability with a multi position hand pressure sensitive safety;
15. To provide a firearm including a locking mechanism which places a conventional external safety in safe mode after a predetermined period of time;
16. To provide a firearm with improved security against theft, unauthorized use, or tampering;
17. To provide an improved gun to serve society as well as the individual owner, and owner's family, to prevent accidental deaths of children and others, including family member suicide, family members shootings, school shootings and the like;
18. To provide a firearm that, if locked, may be quickly and easily unlocked by an authorized individual;
19. To provide a firearm with an anti-theft mode;
20. To provide a firearm with a time-remaining readout feature; and
21. To provide a rifle or shotgun with a push button programmable electronic circuitry combination lock, with a timing device and a motor or solenoid operated gun mechanism blocking rod;

A preferred embodiment of the improved gun incorporates push buttons, programmable electronic circuitry, including combination lock programming, which operates a motor position controlled safety, and with improved ergonomics to inform the user by feel if the safety is ON or OFF, including a timing device to allow the gun to remain unlocked for up to 12 hours, then automatically to become re-locked. The improved gun typically will allow authorized use within two seconds, or less, after switching from its locked mode. By employing the instant invention, the gun may for example automatically re-lock within one second after a grip is released, or up to 12 hours after such release. The lock mechanism is typically interactive with a hand operated safety which, when pulled in, and with the correct combination inserted, allows operation of the gun; and when released, unless the timing device is used, the lock mechanism disables the gun and clears the previous coded entry from the lock. Further, the combination lock is typically cleared of any partial entries when the safety is gripped. Means is also disclosed for locking the gun to an object such as a cable, and permitting quick release therefrom. Also disclosed are means for locking a handle cover to prevent tampering with locking mechanism, and electronic lockout means to prevent repeated combination attempts. As will be seen, the electronic circuitry allows a combination for a combination lock to be changed and made as simple or as complex as desired by the user.

Certain prior internal trigger locks or hammer locks as for revolvers manufactured by Smith and Wesson, blocked the hammer from being cocked, often by the use of a solenoid. Typically, there was no way for a gun user, other than by pulling the trigger, to determine whether the gun's safety was ON or OFF. Also, a user relying on radio waves or magnets might be unsure if the gun was enabled. Allan et al's 1988 U.S. Pat. No. 4,763,431 overcame the problem of the gun user unquestionably and instantly determining whether a gun was locked or unlocked. Allan et al's safety allowed a gun user to determine by feel, even in the dark, the gun's safety status.

The present invention improves over the disclosure of the Allan et al patent. In that patent the safety extended from the grip approximately 0.75 inches, to accommodate the mechanical safety mechanism, which was awkward for the user to grip. The improved safety of the present invention typically extends from the grip a more comfortable distance of approximately 0.2 to 0.6 inches, providing for an ergonomically improved safety. In the prior art, the safety was moved by hand pressure from its extended, safety ON position, after a solenoid released a latch, to its retracted, safety OFF position. In the present invention the safety is typically moved from its extended, safety ON position by hand pressure when a blocker is moved, as by a motor.

In the prior art, the safety would typically be moved by spring pressure from its retracted, safety OFF position to its extended safety ON position, upon user release of the safety. A switch was used to hold the safety "IN" if a user wished to leave the safety OFF. This allowed the gun to be accidentally left unlocked. In the present invention, the safety is moved from its retracted, safety OFF position, to its extended, safety ON position by a motor or spring after hand pressure is released from the safety which signals a microprocessor to operate the motor and block the safety in its ON position. Further, the present invention provides a locking mechanism which includes a programmable timed delay automatic re-locking mode. This is superior to a latch, because the gun cannot be left permanently unlocked. It should be understood that a solenoid may be substituted for a motor; however, a motor is preferred as it typically uses less power.

In addition, typically, where in the prior art if a gun was cocked and unlocked then forcibly taken away from an owner, the gun could be fired, even if the grip safety moved out to locked mode. The design did not address blocking a cocked hammer. If a hammer-blocking rod was designed not only to prevent the hammer from being cocked, but also to block the hammer in its cocked position from being released, another safety problem is created. In this regard, the hammer is typically held in is cocked position by a sear as it interfaces with the trigger. When the gun of U.S. Pat. No. 4,763,431 is cocked and the safety is extended and ON, if the block rod blocked the hammer and if the gun is dropped, or the trigger is moved slightly, the hammer could come off the sear, but is held in its cocked position by the hammer-blocking rod. If the safety is then moved to the retracted, safety OFF position, the hammer blocking rod would release the hammer and the gun could fire without pulling the trigger. The instant invention, as applied to a Smith and Wesson type revolver, uses a hammer block to prevent the hammer from striking the firing pin when the safety is in its extended, safe position. Thus, with the instant invention, a revolver can theoretically be dry fired, cleaned, loaded or unloaded without the risk of firing, if the safety is extended even if the trigger lock is deleted.

The preferred embodiment of the instant invention, applied to a Smith and Wesson type revolver, includes both a hammer block and a trigger lock; both actuated by the safety. When the typical revolver gun is cocked, the trigger needs to be moved by only a very small mount to take the hammer off the sear as previously mentioned. For a production firearm, it may at times be impractical to try and lock a trigger when the gun is locked, and the hammer is cocked, so that the hammer could not come off the sear if the gun were dropped. In the preferred embodiment of the instant invention, and using Smith and Wesson type revolver, the trigger lock is configured not to lock the trigger when the gun is cocked, but instead allow the hammer to fall, to be blocked by the hammer block. The trigger lock then prevents the trigger from being pulled or the hammer cocked.

There is a hammer block in certain firearms such as modern Smith and Wesson revolvers, which is connected to a pin in the rebound slide behind the trigger. If a gun is dropped in the cocked position and the hammer released, the hammer, the trigger and the rebound slide will all be released and move forward. Before the hammer reaches the firing pin, the rebound slide moves enough to have moved the hammer block, so that the upper end of the hammer block is placed between the gun frame and the hammer. If the trigger is pulled when the gun is cocked, the hammer will fall and the hammer block will not move to block the hammer until after the trigger is released, which in turn moves the rebound slide and the hammer block. With the present invention, if the gun is cocked and then dropped, the safety is released, to move the hammer block actuator to move the hammer block to block the hammer. In the preferred embodiment, the blocking of the hammer block is timed to occur in less than one second, regardless if the gun is in timed unlocked mode or not.

Some gun manufacturers prefer a transfer bar instead of a hammer block for revolver type handguns. With a hammer block safety, the hammer block moves up just under the firing pin. Its 0.065+/− inch thickness is more than enough to block the hammer and firing pin from firing the gun. The hammer block is operationally connected to the trigger through the rebound slide. When the trigger is back in its firing position, the hammer block is retracted so as not to block the hammer. With a transfer bar, when the trigger is back in its firing position the transfer bar is in its extended position over the firing pin so that the hammer will strike the transfer bar, which will transfer the blow through the transfer to the firing pin. With the instant invention, a special type of transfer bar may be used which is operationally connected to the transfer bar actuator and safety. The hammer block moves up, and the transfer bar down, to put or place a revolver on safe mode with the instant invention.

Some gun manufacturers do not use a rebound slide. With the instant invention, the rebound slide can be replaced by a trigger lock bar, which moves back and forth from a trigger cocked and un-cocked position, like a rebound slide. As with the Smith and Wesson design, if a revolver employing the safety mechanism of the instant invention with a transfer bar is not cocked, and its safety is extended in its safe position, and the revolver is not in its timed safety re-lock move, the safety will not retract into the handle into safety OFF mode, and the trigger cannot be pulled and the revolver cannot be cocked. If, then, the electronic circuitry programming allows the safety to be gripped and signals the microprocessor to have the motor move the safety to its retracted safety OFF mode, the gun may then be cocked in preparation for firing. If at this point the safety is released, it will be moved by the motor to its safety ON extended position. The trigger can then be pulled once, and the hammer will fall, but it will not strike the transfer bar, which will have moved down so as not to transfer the hammer's blow to the firing pin.

Certain semi-automatic handguns such as the Glock and the Smith and Wesson, Sigma series, have no hammer and no firing mechanism occupying the space behind the ammunition clip on the grip. Using the instant invention, the trigger mechanism of Glock style guns is blocked. The safety and controlling motor are located in the grip behind the ammunition clip. In a preferred embodiment, a module containing a battery, microprocessor and push buttons is located on the lower left-hand portion of the grip and positioned so that a user's right hand fingers do not contact the push buttons while gripping the gun's grip. The module and push buttons are located so that a right handed shooter's left hand, while aiming the gun, can operate the push button or buttons just prior to gripping the gun with a two-handed grip.

A left handed shooter can initially grip the gun in his right hand, then shift hands, or the manufacturer can make some models that will receive the module on the right side, if demand warrants. As with the previously discussed revolver, the safety is configured to inform the user by feel whether the safety was extended in its safe mode or retracted into the grip in a safety off mode. An auxiliary processor may be used to receive signals from the electronic circuitry so as to prevent someone removing the module and simply attempting to unlock the gun as by connecting a battery to terminals exposed when the module is removed. With a hand gun, push buttons may be used at various locations, as for example at the upper left or right hand side portion of a gun's grip, on the previously mentioned module, on a module connected to the clip, on the grip under normal finger gripping locale, or in a module mounted forward of the trigger guard.

1911 style semi-automatic handguns have a safety at the rear of the grip; however they automatically collapse into the grip when the gun is gripped. They are not designed to inform a user by feel if the gun's safety is ON or OFF. The 1911 safety lacks electronic circuitry motor positioning. With semi-automatic handguns with hammers, the motor to control the position of the safety can be located in an enlarged portion of the grip. A safety actuator can force the gun manual safety to its safety on position. Alternately, the safety actuator can allow the manual safety to be switch ON or OFF if the gun's smart safety system is switched off. A safety as previously discussed for Glock type guns can also be used if desired.

A push button combination lock, electronic circuitry, timing device, hand characteristic recognition device, primary and back-up batteries and laser energizing pressure-sensitive safety may be employed. The gun's grip of the instant invention typically has receiver tubes or channels so that the gun can be fastened to a cable or other object to secure against use or theft.

With the instant invention applied to firearms such as rifles or shotguns, it would be undesirable to have them operate with a grip safety. Instead, they would be locked except when the correct combination is used with the electronic circuitry, and associated timing device, which would hold the gun unlocked for a maximum period of time set by the factory, such as 12 hours. A motor would then control a blocking rod to block the gun's firing mechanism and prevent the removal of the safety mechanism while the gun was locked. A back-up battery switch would also be available.

With the instant invention, a module containing motor, safety, actuator, electronic circuitry, with associated timing device with push buttons for programming and safety status indicator may be connected to the gun's ammunition clip or mounted on the gun forward of the trigger guard.

Accordingly, the improved gun in one form basically comprises:

a) a body having a grip, a trigger, a hammer movable in response to trigger movement, and a electronic circuitry carried by the body, b) a hammer having a hammer block, and a block actuator carried by the body for controlling movement of the hammer block for firing the gun, c) a grip associated safety device operatively connected to the actuator, and having first and second positions, said first position characterized in that the safety device is sufficiently extended that the user determines by feel that the safety is engaged and in its first position, the safety device in its first position being further characterized in that it does not move into its second position without correct input to the electronic circuitry, the safety device having a second position characterized as retracted enabling the user to feel that the safety device is in a non-engaged position, and also that the safety device automatically moves move into said first safety engaged position when a user releases the grip, which signals the electronic circuitry, d) a trigger lock connected to the safety device characterized in that when the safety device is in first position, the gun hammer is un-cocked and the trigger is forward, the trigger lock will block rearward movement of the trigger preventing the gun from being fired, and further characterized in that when the gun hammer is cocked and the safety device is moved from second unlocked position to first locked position, the trigger lock will not block the trigger assembly until the trigger is returned to its forward position, e) the safety device further characterized in that its movement between first and second positions is controlled by an electromechanical mechanism controlled by the electronic circuitry responsive to hand pressure on the safety device in accordance with electronic circuitry primary programming and hand pressure specific input.

An additional object is to provide an improved gun, which comprises:

a) gun firing mechanism, b) an electrically energizable motor, c) at least one element operatively connected between the motor and firing mechanism and movable by the motor to alternately enable and inhibit operation of the firing mechanism, d) and user programmable circuitry carried by the gun including push buttons, or push buttons and a hand characteristic scanning element and operatively connected to the motor to control motor effected movement of said at least one element.

These and other objects and advantages of the invention, as well as the details of an illustrative embodiment, will be more fully understood from the following specification and drawings, in which:

DRAWING DESCRIPTION

FIG. 5 is a left side view of another form of gun embodying the invention;

FIG. 6 is a view taken on lines of the backside of a module seen in FIG. 5;

FIG. 10 is a cut away left side view of a gun handle like that of FIG. 9, with components;

Figure 9:
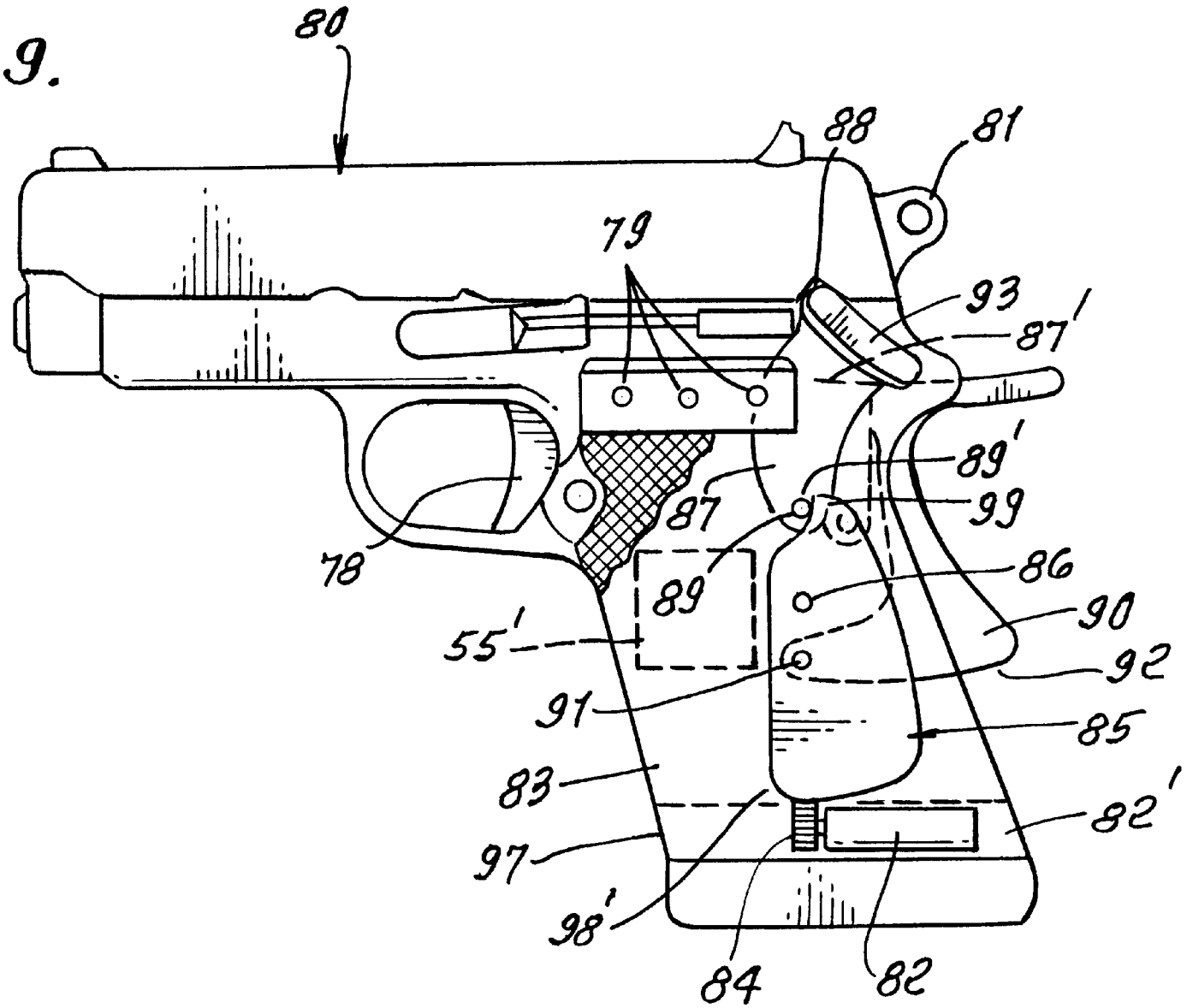
FIG. 9 is a left side view of yet another form of gun employing the invention with components in locked mode.
Figure 11:
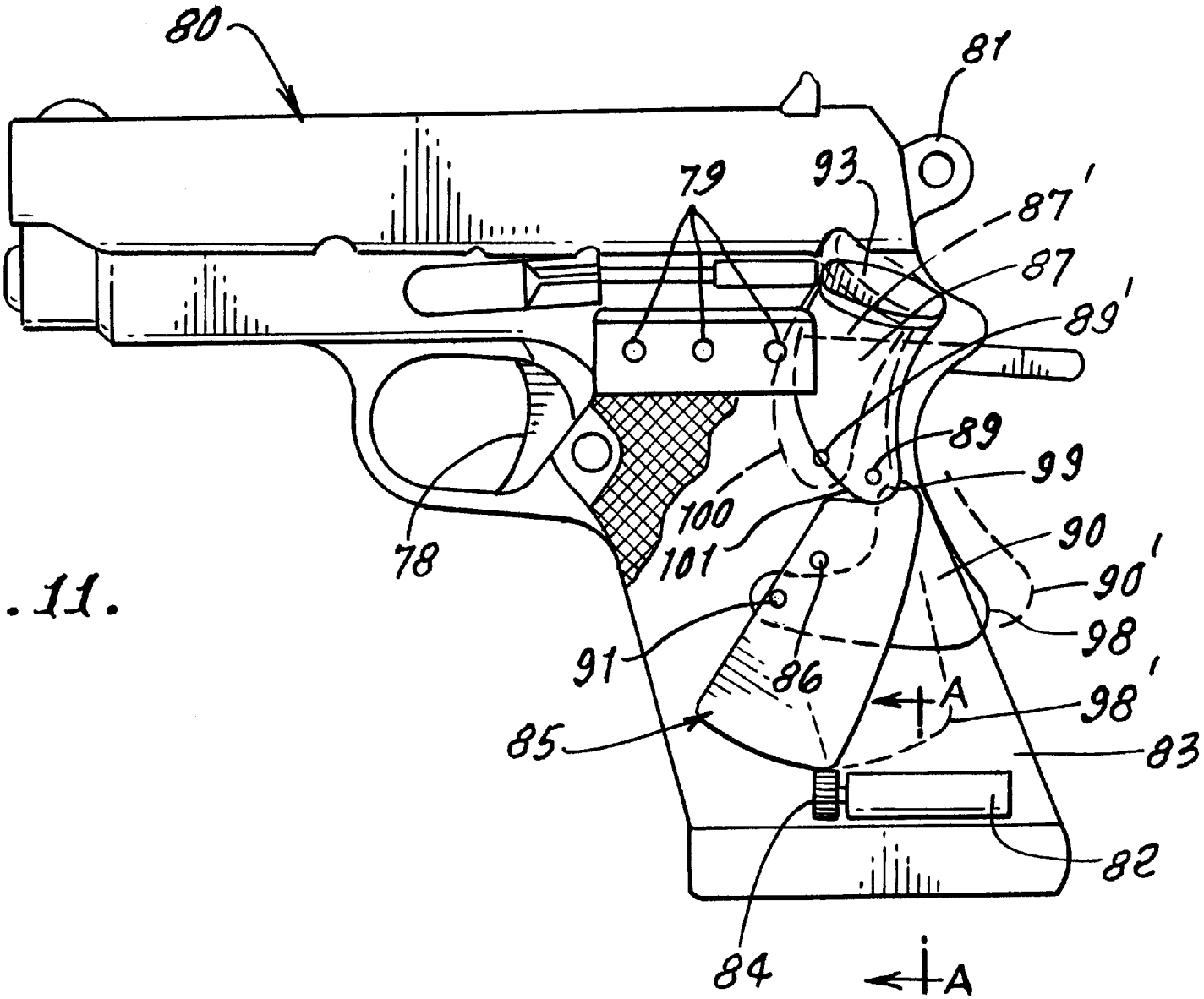
Figure 12:
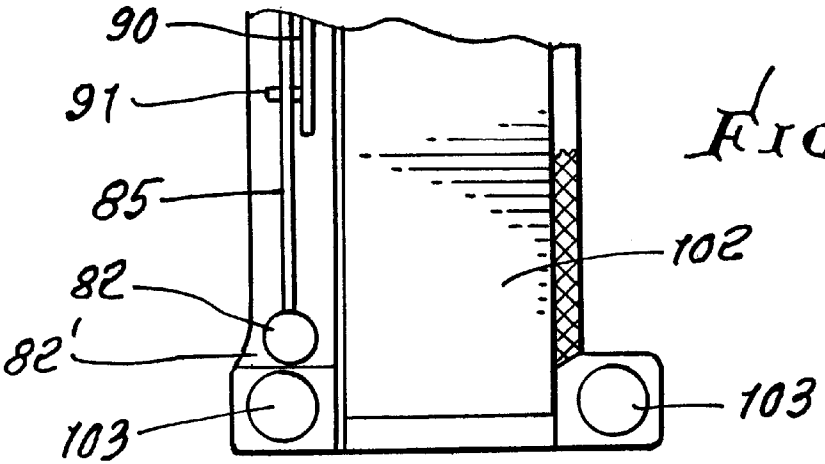
Figure 18:
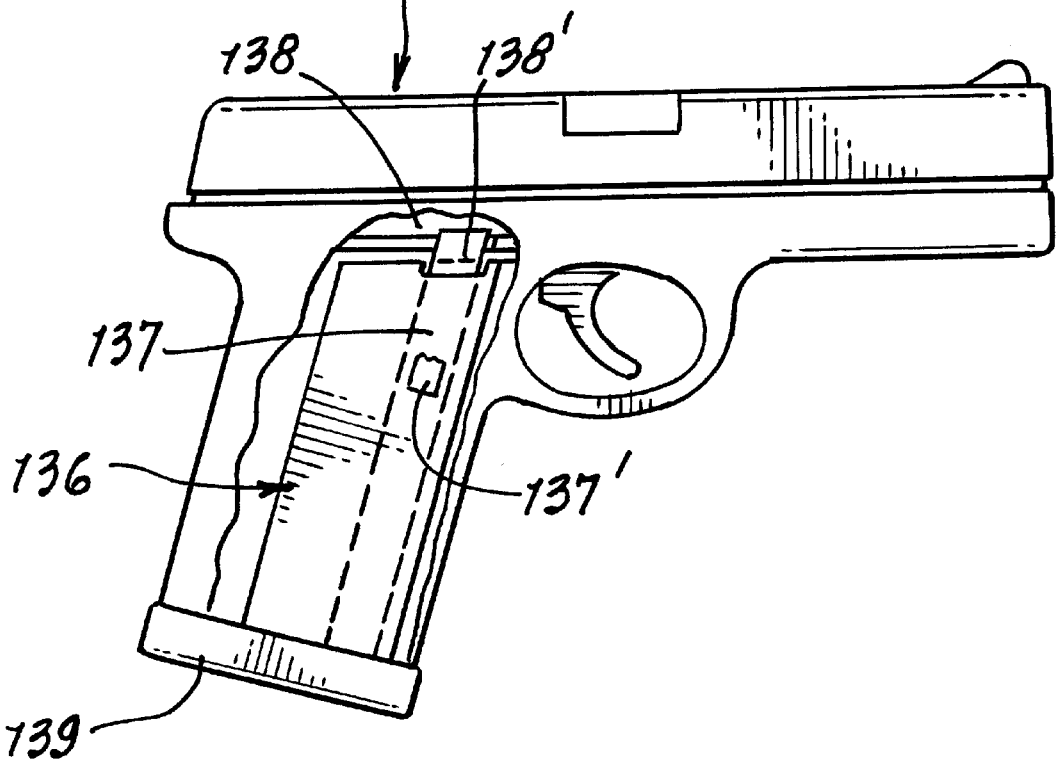
Figure 19:
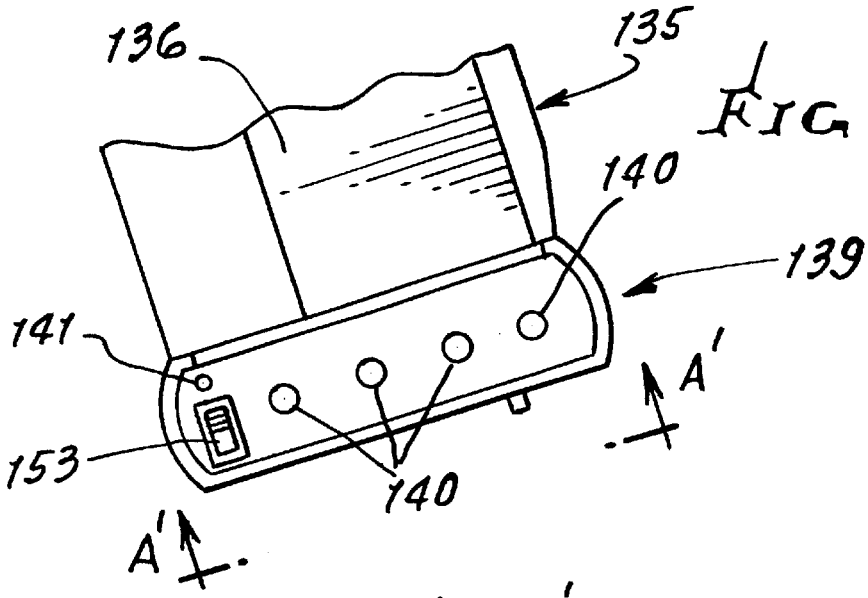
Figure 20:
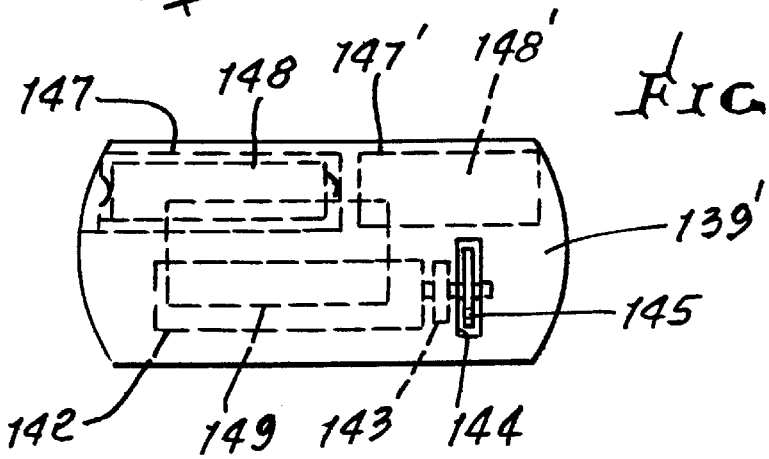
Figure 21:
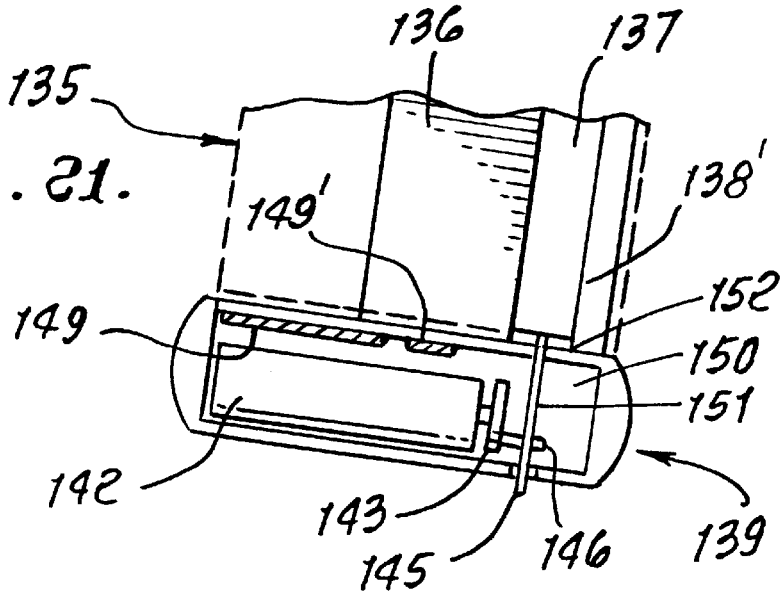
Figure 22:
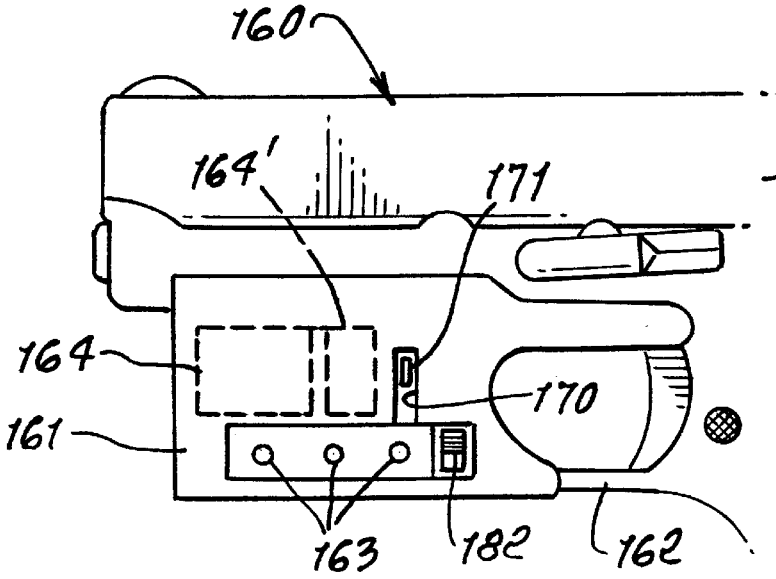
Figure 23:
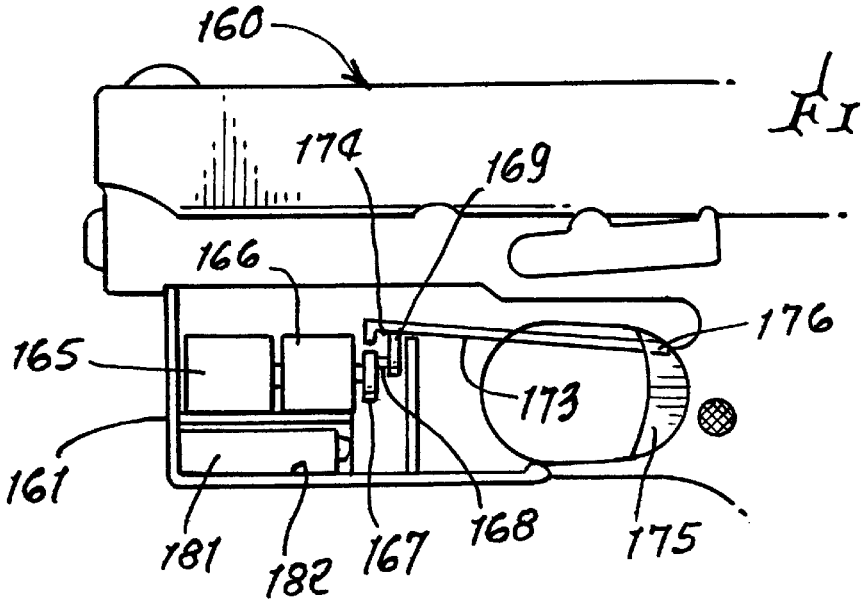
Figure 24:
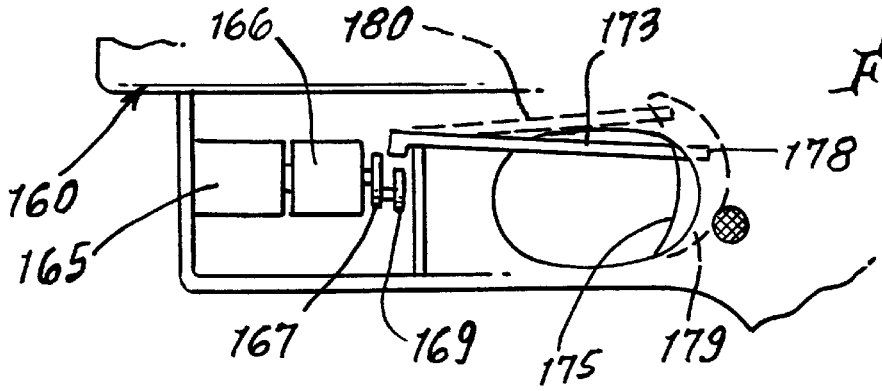

FIG. 10*a* is a fragmentary view of a gun grip;

FIG. 11 is a view like FIG. 9, but showing gun components in unlocked mode;

FIG. 12 is a section taken on lines A—A of FIG. 11;

FIGS. 13–17 are elevations showing gun components;

FIG. 18 is a right side elevation showing a further form of gun embodying the invention; and FIG. 19 is a detailed view of a module seen in FIG. 18;

FIG. 20 is a bottom view of the module seen in FIG. 19;

FIG. 21 is a cut-away view of the FIGS. 18–20 module lower extent;

FIGS. 22–24 show a modified gun with firing control mechanism at front of gun; and FIGS. 25–28 show further modifications.

DETAILED DESCRIPTION

Figure 1:
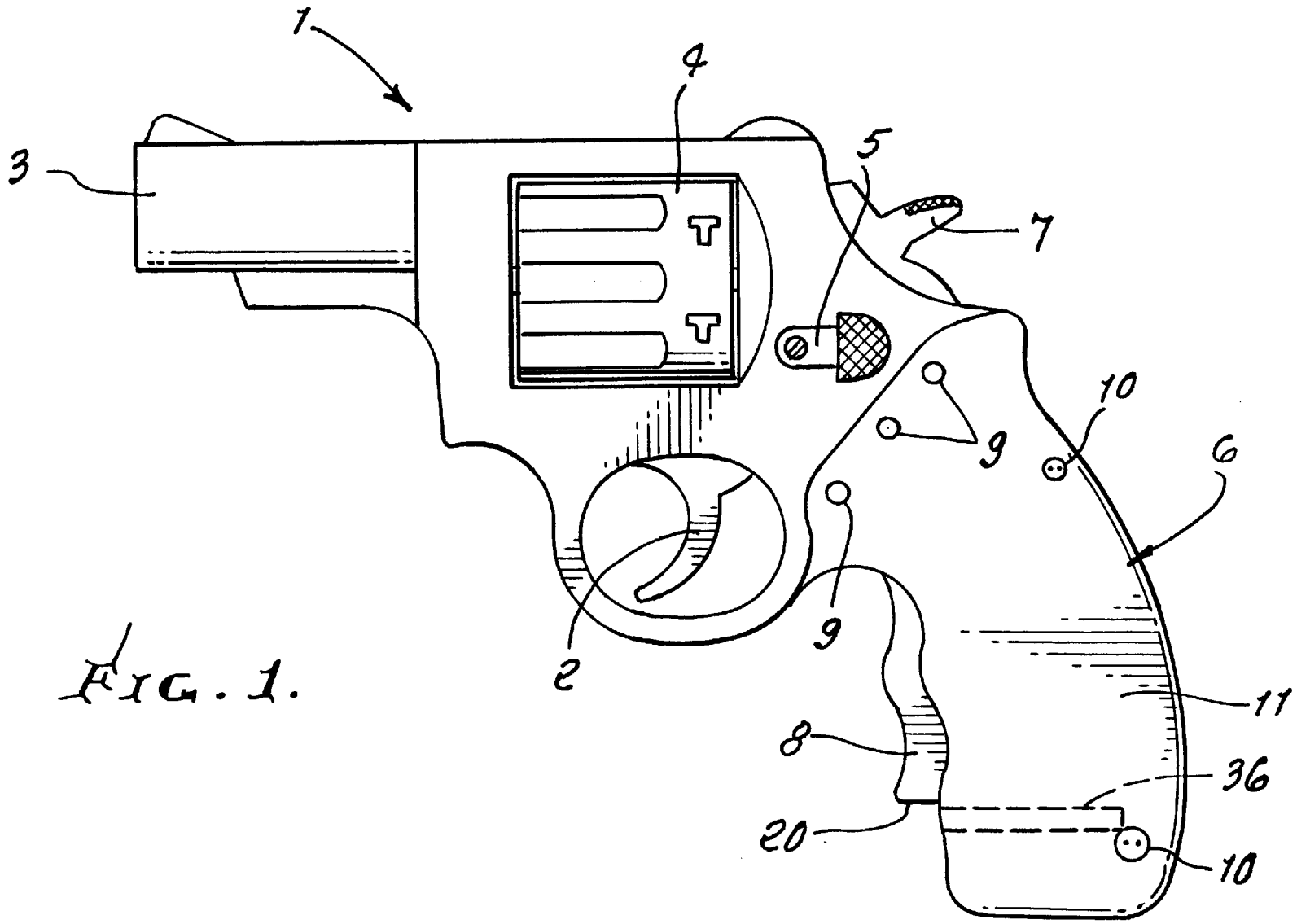
FIG. 1 is a side view of the left side of one form of gun embodying the invention.
Figure 2:
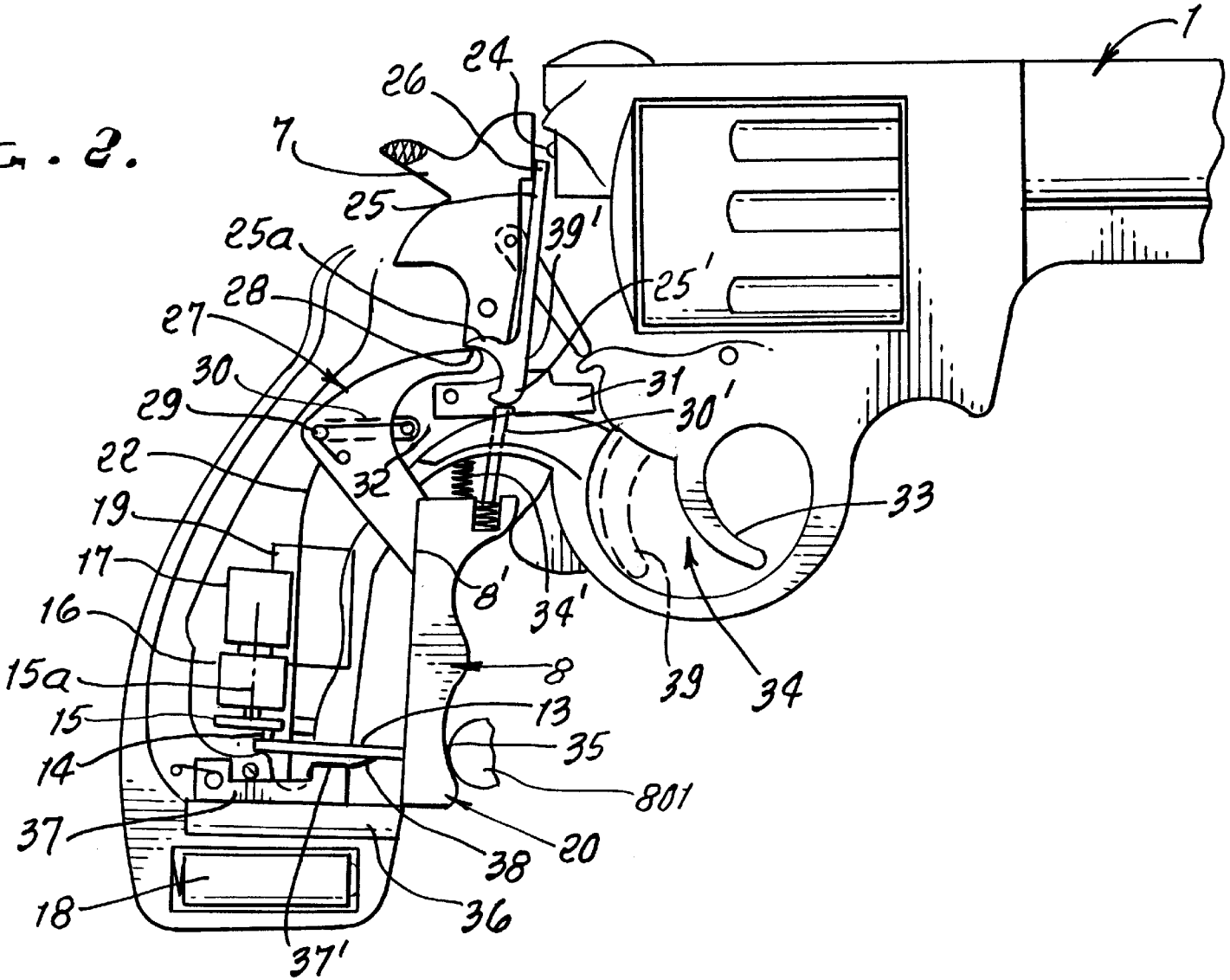
FIG. 2 is a right side view, partially cut away, of the FIG. 1 gun.

FIG. 1 is a left side view of a preferred form of gun such as a revolver 1, with trigger 2, forwardly extending barrel 3, cylinder 4, cylinder release 5, grip 6, hammer 7, and push buttons 9 operatively connected to a Device including memory capable programmable circuitry 19, FIG. 2. The push buttons are in a row, below the hammer, and to the rear of the trigger, and they are on the upper extent of the handle.

Figure 3:
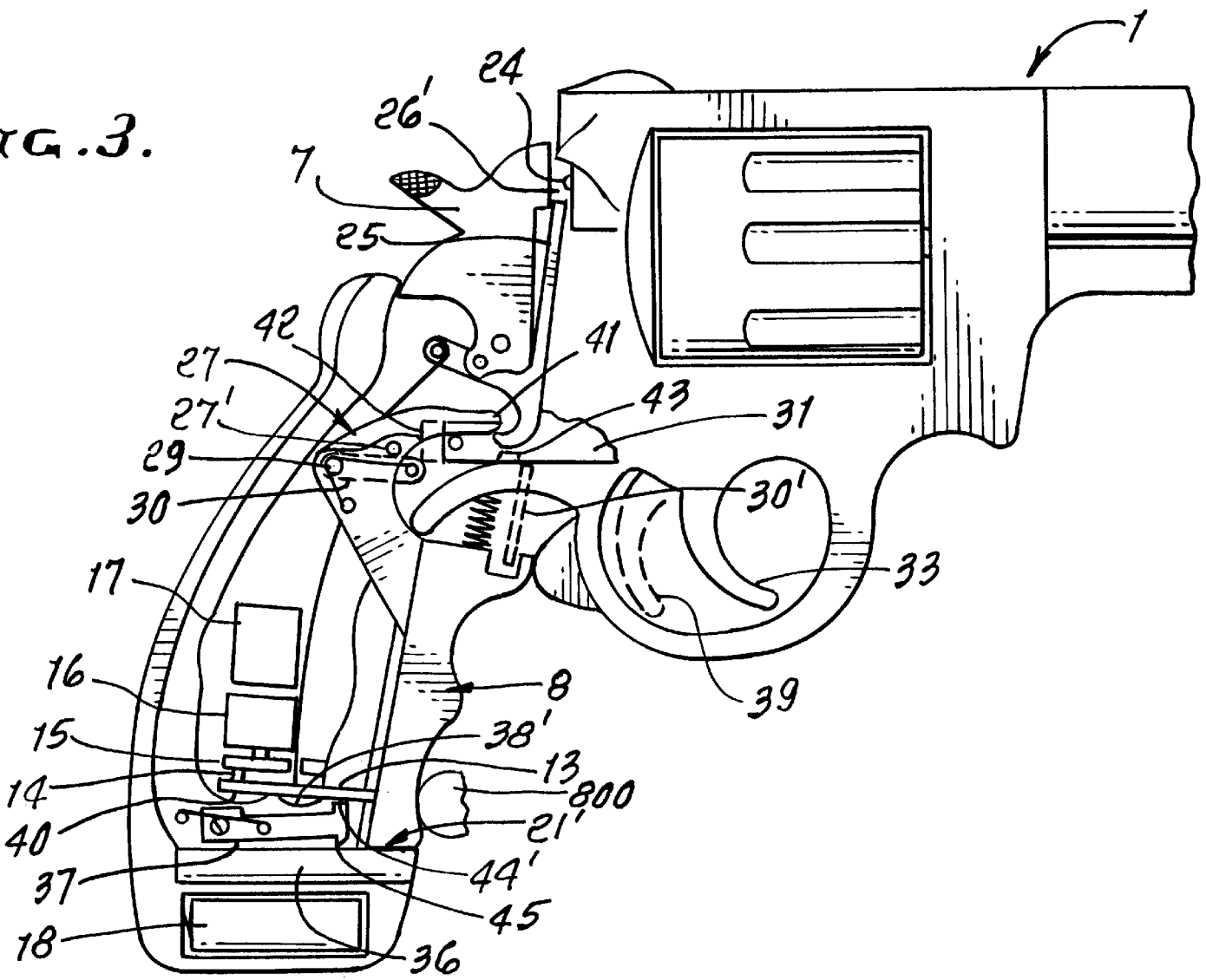
FIG. 3 is a view like FIG. 2, showing gun components in another mode.

Safety 8 is fully extended, forwardly, signifying that the gun safety is fully engaged. Tamper resistant fastener 10, connects the gun grip handle 11 to revolver 1. A receiver tube 36 is configured and located in the handle lower extent to receive gunlock wishbone 134, FIG. 17. Safety mechanisms are schematically indicated in FIGS. 2 and 3.

FIG. 2 is a partial right side view of the revolver 1 of FIG. 1. Safety 8, in its extended ON position as indicated at 20 is held in position by safety actuator 13 within the handle, and which is connected to a safety actuator pin 14 eccentrically carried on a wheel 15 having an axis of rotation 15*a*. position, when the gun is not in its timed safety OFF 16, and such gearing is powered by electric motor 17, energized by motor battery 18. Device 19 controls and directs motor 17 to turn wheel 15 so that safety actuator 13 to block safety 8 in its extended safety ON position 20.

Revolver 1 main spring 22 is connected to hammer 7 which is blocked from contacting firing pin 24 by hammer block 25 at its terminal 26 so that the revolver is prevented from firing. The position of terminal 26 is determined by hammer block actuator 27 at surface 28 that engages a lower lip 25*a* of elongated block 25, to control up and down movement of 25. The hammer block actuator 27 is connected at 8' to the safety 8, both of which pivot about the axis of a fixed pivot 29 operatively connected to the handle. Therefore, as safety 8 moves leftwardly in FIG. 2, hammer block 25 drops.

The trigger lock 30 also pivots off the safety pivot axis 29 and blocks the rearward movement of the rebound slide 31 at 32, thus locking the trigger 33 in position due to the interdependence of the trigger assembly 34 which includes the rebound slide 31 and trigger 33. Also, if the trigger 33 cannot be pulled to broken line position 39, the hammer cannot be cocked as at 23', FIG. 4 because a flange on trigger assembly 34' overlaps hammer flange 23' at 39'. It should be recognized that the trigger lock 30 could be relocated to 30', or elsewhere, so as to block the trigger 33 either directly or indirectly, especially for revolvers, which do not have rebound slides. As seen in FIG. 2, spring 34 holds safety 8 at its extended position 20 until a user grips safety 8, applying some pressure at 35 which allows microprocessor 19 to receive programming or an unlocking signal from push buttons 9, FIG. 1. Receiver tube 36 is configured to accept gunlock wishbone 134, seen in FIG. 17, which would be locked into receiver tube 36. Receiver catch 37 seen in FIGS. 2 and 3 is positioned to catch the wishbone as receiver catch spring 38, on safety actuator 13, is positioned over the receiver catch 37, at 37', when safety 8 is extended in its safety ON position 20, seen in FIG. 2.

FIG. 3 is a partial right side view of the revolver 1 as depicted in FIG. 2. However, the safety 8 is retracted at 21 when compared to its extended position 20; and the trigger 33 can be pulled to position 39 and the revolver 1 can be fired. The microprocessor 19 has been programmed to receive input from the push buttons 9, FIG. 1, directing the motor 17 to rotate wheel 15, 180 degrees through the gear 16, resulting in the safety activator pin 14 at position 40 moving the safety actuator 13 inward so that the safety 8 may be retracted at 21 by user's hand (see finger 801). Safety 8 and hammer block actuator 27 have rotated at safety pivot 29, pushing hammer block 25 down at 41, so that there is no obstruction at 26' blocking the hammer from striking the firing pin 24. Trigger 33 is allowed to move to position 39 because the rebound slide 31 can pass above trigger lock 30 as seen at 42, due to rotation of hammer block actuator 27, pin 27', safety 8 and trigger lock 30. Further, alternate trigger lock 30' has been retracted from rebound slide slot 43, to allow the trigger 33 to be pulled to cocked position 39. Receiver tube 36 for receiving gunlock wishbone 134 has been cleared of receiver tube catch 37 seen at 45 in FIG. 3. Receiver catch spring at 38' has moved upwardly, allowing receiver tube catch 37 to move up at 44', releasing the gun lock wishbone if it had been inserted into receiver tube 36.

Safety 8 is in its retracted safety OFF position 21, because it is being held there by a user's hand (see finger 800). The electronic circuitry 19 has been programmed to direct or operate motor 17 to move safety 8 blocker 13 to block safety, when the safety is released by user, to its extended, safety ON position, when the gun is not in its timed safety OFF mode. While the gun is in its timed safety OFF mode, the safety can be moved from safety ON position 20 to safety ON position 21 by the motor 17 which will rotate safety OFF position 21 the wheel 15 and safety actuator pin 14, 180 degrees when a user's hand applies pressure to safety (see finger 801, FIG. 4). FIG. 3 depicts the revolver 1 of FIG. 1 wherein the safety 8 has been retracted at 21, and the revolver trigger 33 is not prevented by the trigger lock 30 from moving to position 39 since the rebound slide 31 can pass over the trigger lock 30 at 42. Also, the cocking of the hammer, shown at 23' in FIG. 4 in preparation for the gun firing, is allowed, as the trigger assembly 39 is not locked by the trigger lock 30.

Figure 4:
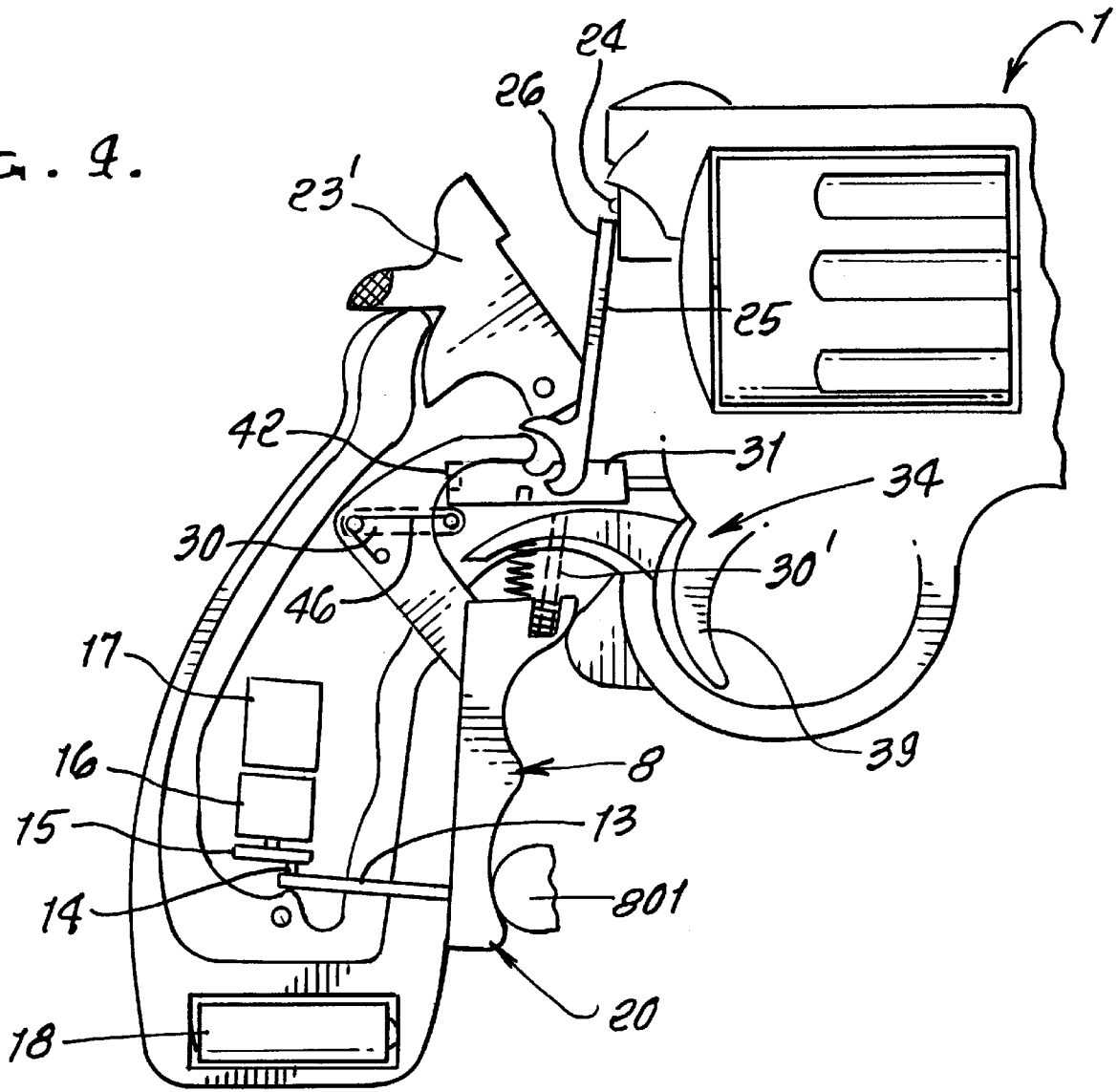
FIG. 4 is a view like FIG. 3, showing gun components, including the trigger in yet another mode.

FIG. 4 is a partial right hand view of revolver of FIG. 1. If safety 8 is retracted as at 21, FIG. 3, then the hammer is cocked as shown at 23' which also places the trigger 33 at position 39, and then the safety 8 is returned to its extended safety ON position 20; the rebound slide 31, then is at position 42 and cannot be blocked by trigger lock 30 which is intentionally prevented from locking the trigger assembly 39. The hammer block 25 is at up-position also as seen at 26, FIG. 2, so as to block the hammer 23 from striking the firing pin 24. It should be recognized that with some revolvers, the firing pin is affixed to the hammer 23; however the principal of blocking the hammer works the same, in preventing the firing pin from firing the gun. If the trigger 39 is pulled, the hammer will fall harmlessly to strike the hammer block 25, and the trigger 39 would then be manually released and move to its forward position 33 as would the rebound slide 31, releasing the spring 46 to move the trigger lock 30 to again block the rebound slide as at 32, FIG. 2. Alternate trigger lock 30' is prevented from locking trigger assembly 34 until trigger assembly 34 moves back to its position as shown in FIG. 2 and rebound slide slot 43 aligns with alternate trigger lock 30'.

FIG. 5 is a left-hand view of a semi-automatic handgun 50. Safety 51 is in its extended safety ON position indicated at 52; removable module 56 (on the gun handle 802) has push buttons 53 for programming electronic circuitry 59, seen in FIG. 6. Indicator light 54 informs user of programming modes during programming, warns of low batteries, and informs user of prior incorrect combination entries. It is understood that push buttons could be located elsewhere, as at 55, 55', and 55" as well as light 54. Module 56 is located so that a user's right hand and fingers at 57' gripping the grip 57 would not grip the module and block the push buttons 53 from being operated by a user's left hand. An optional laser sight may be added at 60. A laser at sight 60 may be turned ON by depressing safety 51, here located at the rear of handle 802. It should be understood safety 51 may be located in front of grip, as safety 8 FIG. 1. Optional hand characteristic scanning element may be located at 55', or 59' when recognition circuit and electronic circuitry 59' may be used with electronic circuitry 59 and safety 51, as previously described.

FIG. 6 is a view of the backside 56' of module 56; with batteries 58; microprocessor 59 and button catch 54' for snapping module to grip 57. Back plate of module 56' is not shown. It should be understood, that the module may be placed on right side of grip for left handed persons. Electrical contacts 58' connect circuits to grip 57 electrical circuit 61', FIG. 7. Module 56 may be replaced by module 56' forming a portion of an ammunition clip and safety 51 may be eliminated as shown in more detail at FIGS. 18, 19, 20 and 21.

Figure 7:
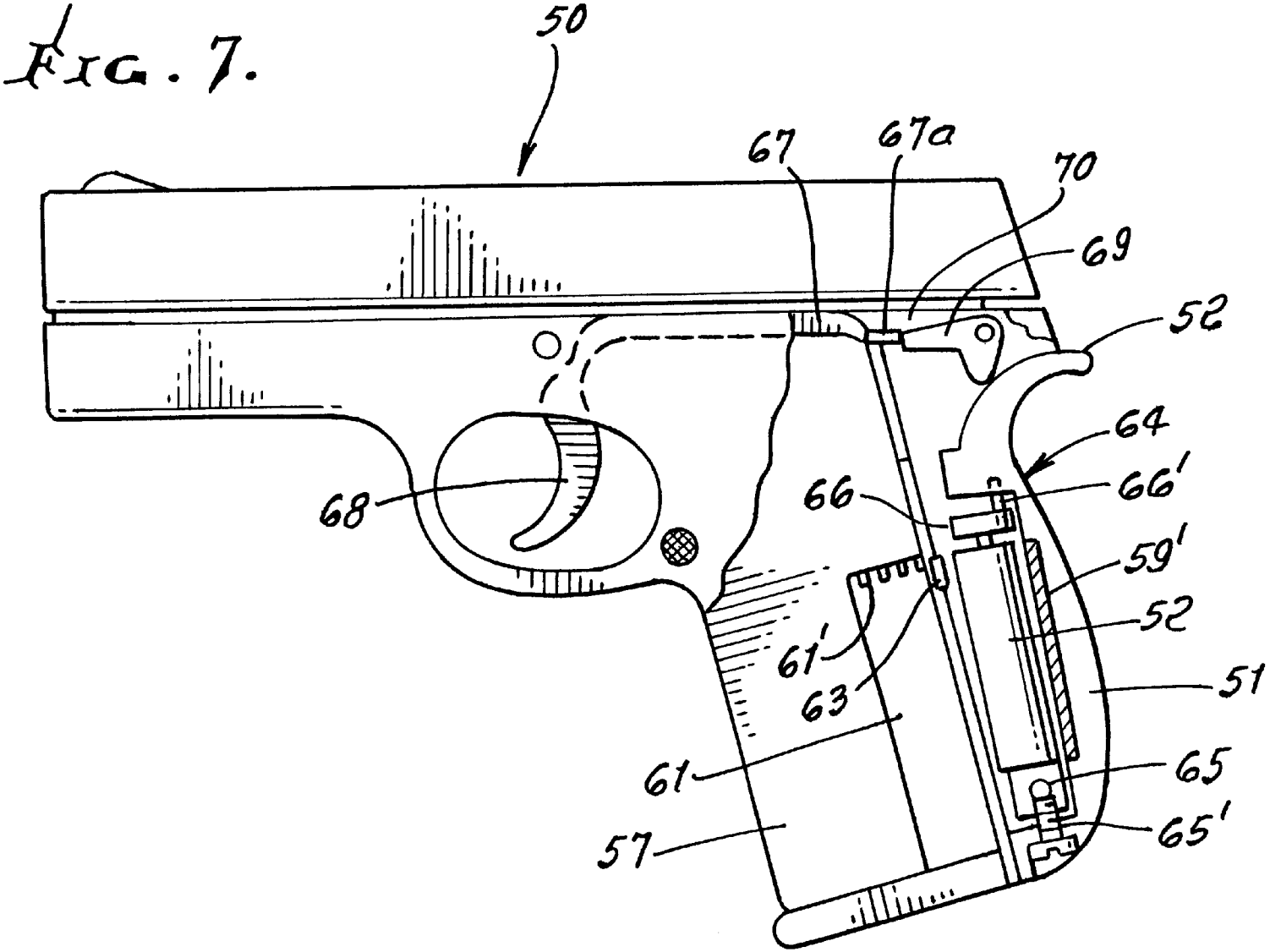
FIG. 7 is a view like FIG. 6, partially cut away to show internal components.

FIG. 7 is a partial cut away left side view of semi-automatic handgun 50 of FIG. 5. Module 56 has been removed, leaving module slot 61 and exposed electrical contacts 61'; safety 51 is in its extended safety ON position indicated at 52. The curved top of safety 51, at 52, in the preferred embodiment would be a contrasting color such as white, so that the user can easily visually confirm that the safety 51 is extended. Motor and gears 62 will depress a switch 63 to energize electronic circuitry 59, if the safety 51 is pressed at region 64 during gripping of grip 57. Safety 51 pivots at 65. Wheel 66 on motor 62, with safety actuator pin 66', holds safety 51 in its extended 52 safety ON position. Trigger bar 67 is connected to trigger 68. Gun 50 cannot be fired as spring-loaded trigger lock 69 blocks trigger bar 67 movement at 70, thus locking trigger 68 in position, as depicted. Anti-tamper screw at 65' prevents removal of pivot 65 and tampering with the mechanism. Separate processor 59' is connected to electronic circuitry 59 and prevents the motor 62 from working in the event someone removes module 56 and attempts to overcome the gun's safety by attaching battery leads directly to exposed electrical contacts 61.

Figure 8:
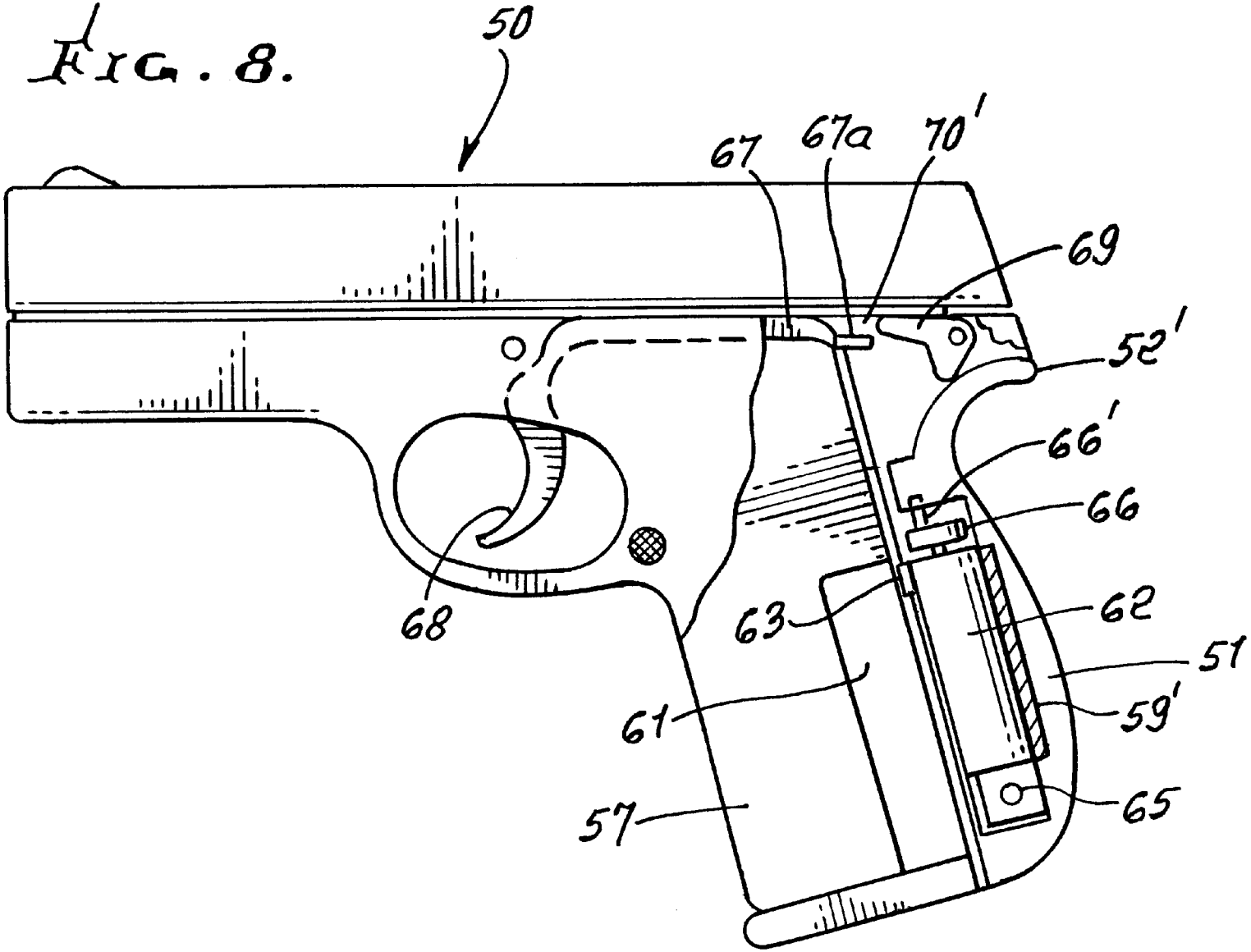
FIG. 8 is a view like FIG. 7, showing gun components in another mode.

FIG. 8 is a partial cut away, left side view of gun 50 of FIGS. 5 and 7. However, wheel 66 and safety actuator pin have rotated 180 degrees. Safety 51 is now in its retracted, safety OFF position, which can be determined by feel by the user and because the visible extended portion of the safety at 52, FIG. 7, has retracted (forwardly) into the gun 50, at 52'. The trigger lock 69 has been rotated clockwise by the safety 51 at 71, unblocking the trigger bar 67 at 70', so that the trigger 58 can move the trigger bar 67 to the right, allowing the gun 50 to be fired. Note rightward extension 67*a* of bar 67, blocked by 69 in FIG. 7, and unblocked in FIG. 8.

FIG. 9 is a partial cut away view of a semi-automatic handgun 80 with hammer 81. Because the motor of the gun of FIGS. 5, 7 and 8 has been replaced by hammer spring mechanisms, not shown, motor 82 has been relocated to an enlarged lower portion of the hand grip 83, at location 82'. Gear 84 on motor 82 rotates safety actuator 85 on pivot 86 to hold safety 87 in its safety ON position seen at 88. Safety 87 in safety ON position at 88 and 89', and at safety pin at 89, is held by upper portion of safety actuator 99 in safety ON position 89'. Optional second safety 90 may be used and connected to the safety actuator 99 by a pin at 91 when the gun 80, safeties 87 and 90 are engaged as shown in FIG. 9. The safety 90 located at the rear of the handle or grip is shown extended as indicated at 92, and a user can tell by feel that the gun 80 safety 90 is ON. If optional safety 90 is not used, a user can tell if the safety 87 is locked in its safety ON position by safety actuator 85 by manually pressing down at 93 on safety 87. Thus a user can tell by feel if the gun's primary safety 87 can be switched OFF by switching the safety 87 OFF at 93. But this requires use of the user's thumb, which is unlike being able to automatically tell by feel if safety 90 is in its extended safety ON position at 92 or retracted safety OFF position at 98. Optional hand characteristic scanning element 55' is schematically shown as located on or in grip 83. Appropriate guides for described movement of the components are provided.

FIG. 10 is an inside view of right hand side of grip 83' having motor controlling electronic circuitry 94, timing device 94', batteries at 95, auxiliary battery compartments at 96, and hand characteristic recognition device or devices 59'. Grip 83' and 83 in the preferred embodiment are of monolithic construction and joined at 97. Optional hand characteristic circuit 94' and motor controlling electronic circuitry 59' are shown.

FIG. 10*a* is a partial view of prior art structure of a semi-automatic handgun 80', also seen at FIGS. 9, 10, 11 and 12. Safety 87" is totally manually operated by a user's thumb, with no motor 82, safety actuator 85 or microprocessor 94 being used. Safety 87" does not extend under grip 83" cover as at dashed lines 87' in FIGS. 9 and 10. Prior art safety 87" and its internal mechanism have not been changed by the instant invention; rather, the safety has been lengthened below dash lines 87' in FIG. 9, so that the safety actuator 85 controls the position of the safety as will be seen.

FIG. 11 is a partial cut away view of the gun 80 of FIG. 8. Safety actuator 85, pivoted at 86, holds the safety 90 in its recessed safety OFF position, received in the grip 83, at position 98. Optional safety 90 is attached to safety actuator 85 at pin 91. Motor 82 has moved safety actuator 85 to a position as indicated. Upper portion 99 of safety actuator 85 has moved to the right as compared to its position shown in FIG. 9. This allows manual safety 87 to be manually pressed downwardly at 93 so that safety pin 89 and safety 87 can move freely from manual safety ON position at 100, to manual safety OFF position at 101.

Thus, if the timing mechanism 94' associated with the electronic circuitry 94 indicates a programmed period of time has transpired, and manual safety 87 is at its safety OFF position at 101, motor 82 will be instructed by the electronic circuitry 94 to move safety actuator 85 counter-clockwise from its position as indicated at 98 to its safety ON position at 98'. At the same time, the upper portion of the safety actuator at 99 will force safety 87 pin 89 leftwardly to position 89'. At the same time, safety 90 will be forced by safety actuator 85 at pin 91 to safety ON more protruding position at 90'. It should be understood that a blocking rod can be attached to the safety actuator 85 to block a portion of the gun mechanism. Alternately, it should be understood that a trigger lock 69 or mechanism lock that stayed locked unless pushed out of the way by a rod or safety, as for example at 71, FIG. 8 and at 26', FIG. 3, could be used. Manual safety 87 is below dashed line 87', and safety actuator 85 and safety are located behind grip cover 82', FIG. 12.

The advantage of the gun 80 is that it can be locked and unlocked manually by a conventional manual safety switch 87 and the manufacturer does not need to re-design the gun. However, there is an override automatic safety system, at least consisting of electronic circuitry 94, push buttons 79, motor 82, gear 84, manual safety actuator 85 and extended portion of manual safety 87 below dashed line 87' which always will return the gun 80 to a safety mode after a programmed time period.

FIG. 12 is a partial cross-section view of the FIG. 11 grip at section A—A, FIG. 11, showing motor 82, safety actuator 85, and safety 90 connected together by pin 91. Ammunition clip 102 is in place in the grip, to feed cartridges into firing position with respect to the gun barrel, as is known. Receiver tubes 103 function similarly as respects receiver tubes 36.

Figure 13:
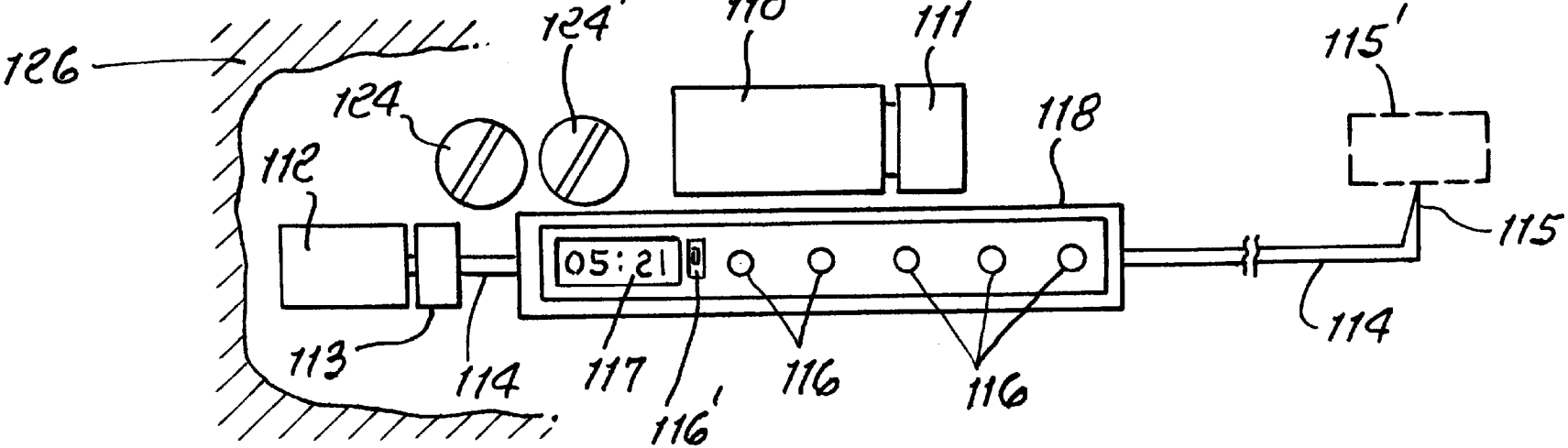
Figure 15:
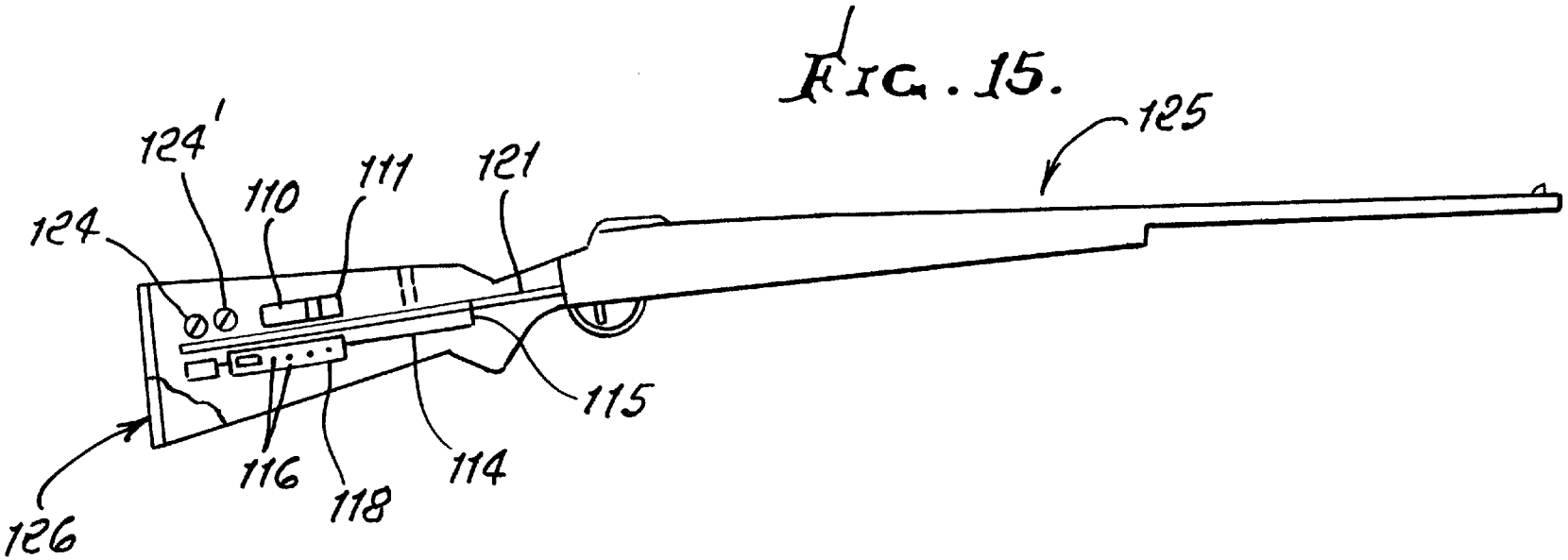

FIG. 13 is a detailed view of a locking mechanism for use in a firearm larger than a handgun such as a rifle or shotgun shown in FIG. 15. electronic circuitry 110 and timing device 111 may be programmed by push buttons 116, in housing module 118 to provide an automatic re-locking device when connected to motor 112, gears 113, and blocking rod 114. Blocking rod is configured to block some portion of a firearm's mechanism 115' so as to prevent it from firing as by interposition of blocking rod block 115 relative to mechanism 115'. For firearms such as rifles and shotguns, there typically is a manual safety which can be blocked in a safety ON mode, such as with the gun at FIG. 10, or depending on the make and model of the firearm, simply blocking a vital portion of the gun's mechanism may be more practical. Option time remaining readout 117 may be used. A cover plate may be used over housing module 118. Switch 116' may be used to switch from battery in compartment 124 to battery in compartment 124', as back up power in case of battery failure. FIG. 13 mechanism is shown as carried by firearm 125 stock 126 in FIG. 15.

Figure 14:
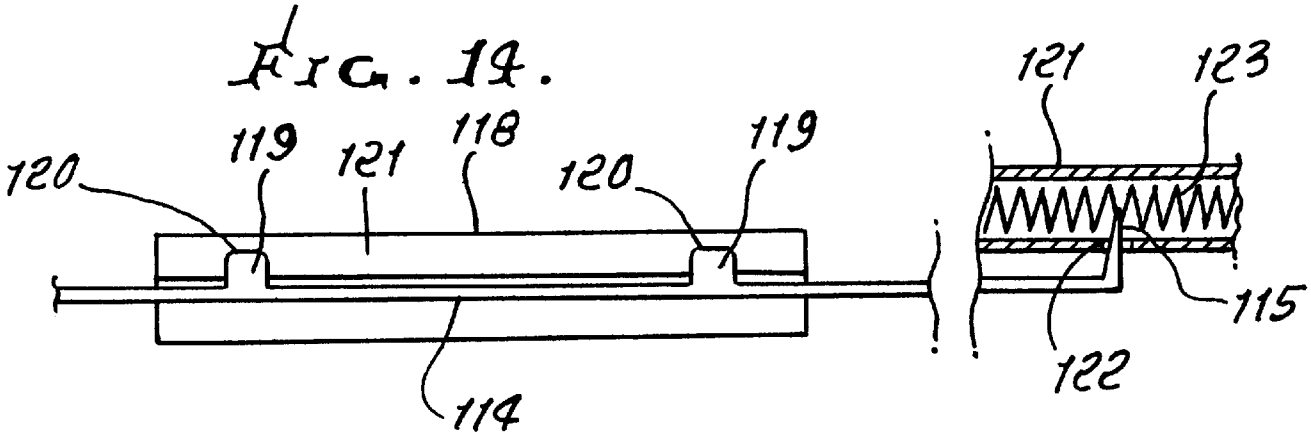

FIG. 14 is a cut-away view of the rear portion of housing module 118, without push buttons 116 and time remaining readout 117. Tabs 119 on blocking rod 114 in lock position at 120 rest on back 121 of housing module 118 so as to prevent removal of housing module when gun 125 (see FIG. 15) is in locked mode. Blocking rod block 114 in locked mode prevents or blocks some portion of a firearm's mechanism. For example, the action spring tube 121 of a shotgun has an opening 122 (see FIG. 14) to allow the blocking rod block blocking part 115 to rotate on the blocking rod so as to block action spring 124, thus preventing gun 125 from functioning.

FIG. 15 is a view of a firearm 125 with stock 126 containing spring action tube 121, action spring 123, blocking rod 114, blocking rod block 115, housing module 118, push buttons 116 operable to program electronic circuitry 10 and associated time device 111. Battery compartments in the stock are located at 124 and 124'.

Figure 16:
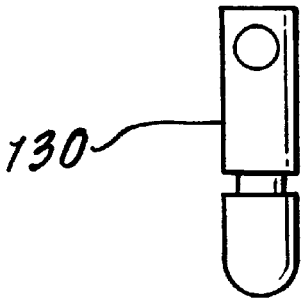

FIG. 16 is a view of the locking pin 130 which may be used, for instance, when a gun is mounted in a police car, or when a sporting gun is stored to prevent theft. It may be pulled out after the correct combination, via the push buttons 116, has been entered.

Figure 17:
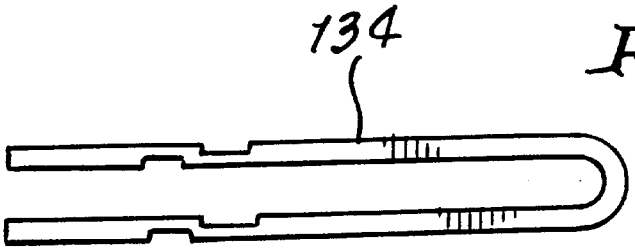

FIG. 17 shows a U-shaped gun cable lock 134 for securing gun 1, FIG. 3 or gun 80, FIG. 12, for example, by inserting in receiver tube 36, FIG. 3, or 103, FIG. 12. It should be understood that, singular, double, rectangular, or round gun cable locks or channels as disclosed in U.S. Pat. No. 4,763,431 to Allan may be used. It should be understood gun cable locks may be mounted so that gun may be secured to an object.

FIG. 18 is a partial cut-away view of the right hand side of a semi-automatic handgun 135 with the ammunition clip 136 exposed. Safety 137 has been extended upwardly blocking the gun's firing mechanism at 138 preventing it from firing. Safety has projection schematically indicated at 137' which prevents ammunition clip 136 from being removed when safety mechanism at FIGS. 19, 20 and 21 is engaged. Module 139 is located at the lower end of ammunition clip 136, which is attached to and inserted into gun 135.

FIG. 19 is a left-hand view of module 139, with push buttons 140 for programming motor controlling microprocessor 149 seen in FIG. 20. Light 141 indicates programming status during programming. Switch 153 allows use of alternate battery 148'.

FIG. 20 is a view taken on lines A'—A' of the bottom of module 139, which is sealed. Ammunition clip 136 with module 139 must be removed from gun 135 to access the interior of module portion 150. Slot 144 allows a portion of the safety actuator 151 to protrude at 145 when safety 137 is retracted and OFF at 138', to indicate to user by feel or sight, the gun's safety status, when safety 137 is extended at 138.

FIG. 21 is a cut-away right side partial view of module 139, gun 135 and clip 136. Motor 142 with wheel 143 and pin 146 have retracted safety actuator 151, which is connected to and forms part of safety 137. Safety 137 which controls the enabling and disabling of the firing mechanism, has moved to its safety OFF position as indicated at 152 and 138'. Safety actuator 151 protrudes through the bottom of the module 139, at 145, to inform the user visually and by feel that safety 137 has been retracted to a position indicated at 138' and gun 135 can be fired. Electronic circuitry 149 is powered by battery 148 in battery compartment 147, which can be accessed without removal of clip 137 and module 139 from gun 135. Alternate battery 148 is provided in alternate battery compartment 147; and may be used in case of battery failure by use of switch 153.

FIG. 22 is a left-hand side partial view of a gun 160 with safety module 161 attached to gun 160 in front of trigger guard 162 and below gun barrel 160. The module incorporates push buttons 163 provided for programming electronic circuitry 164 as a combination lock with timing mechanism 164'. Module 161 may be attached to the gun 160, or form a part of the gun 160.

FIG. 23 is a left hand side partial view of gun 160 of FIG. 22, with safety module 161 cut-away to reveal battery 181 in battery compartment 182 with electronic circuitry controlled motor 165, gears 166, wheel 167, pin 168, and safety 169. A portion of safety 169 protrudes through slot 170 in safety module 161 at safety position 171, the gun of FIG. 22 allowing user to tell by feel and sight whether safety 169 is engaged or not. Battery 181 supplies power to electronic circuitry 164 and motor 165. Switch 182 allows use of back-up battery, not shown. Safety 169 locks trigger lock 173 at 174, which is attached to trigger 175 at 176. Battery compartment 182 is sized to accommodate primary battery 181 and back-up battery, not shown. Safety module cannot be removed while safety is locked. Battery compartment is accessible in front of module at 183.

FIG. 24 is a left-hand side partial view of a gun 160 of FIGS. 22 and 23. Wheel 167 has rotated 180° from view at FIG. 23, moving safety 169 from blocking trigger lock 173. Trigger lock 173 has moved to position 178, and trigger 175 has been pulled to position 179. Alternate location for trigger lock through frame of gun 160, is indicated at 180.

Figure 25:
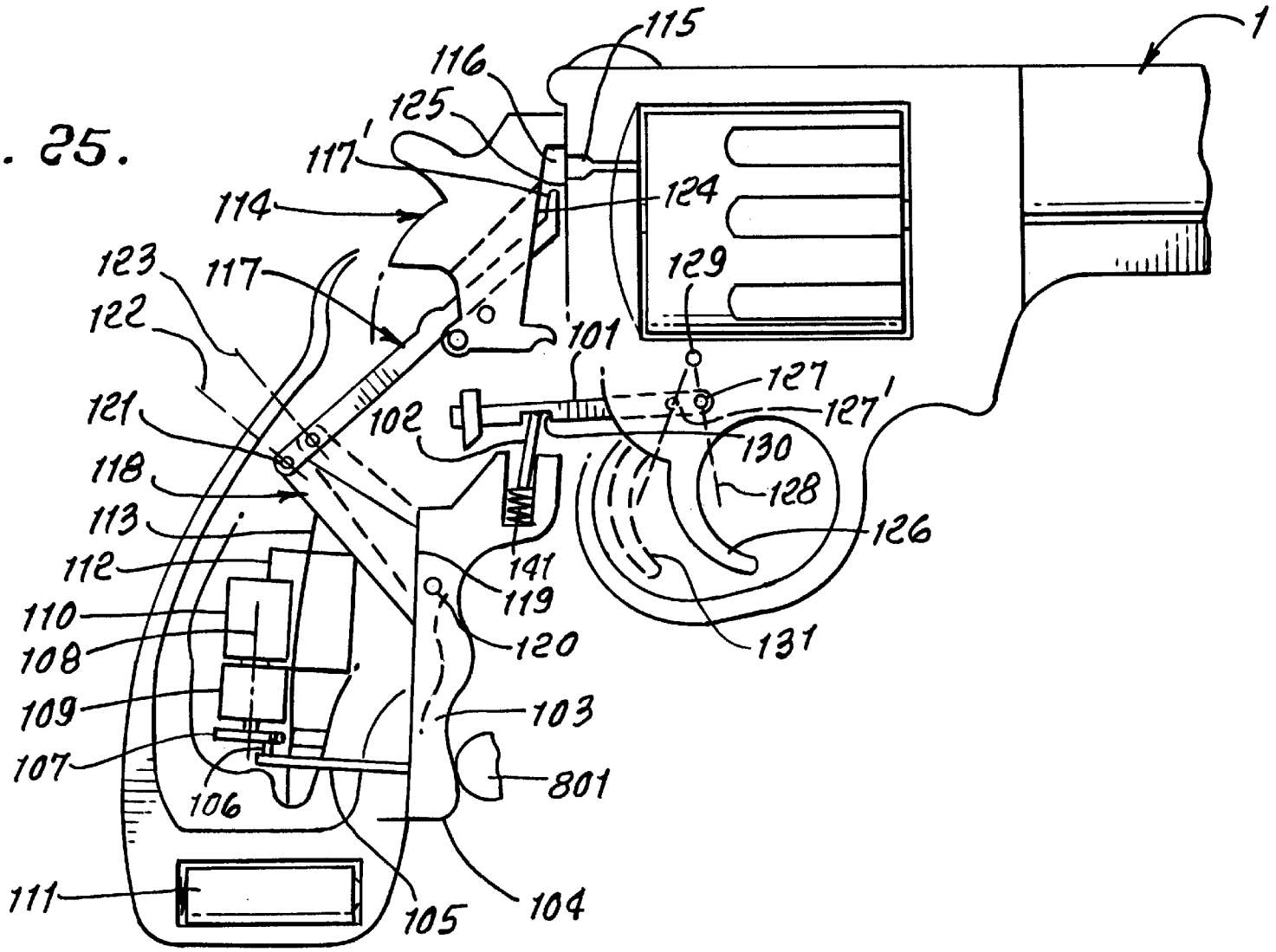

FIG. 25 is a partial right side view of the revolver of FIG. 1 using a transfer bar 117 instead of a hammer block 25. Trigger lock bar 101 is used instead of rebound slide 31. Trigger lock 102 works like trigger lock 30' of FIGS. 2, 3 and 4. Safety 103, in its extended ON position as indicated at 104, is held in position by safety actuator 105 within the handle, like safety actuator 13 of FIG. 2, and is connected to safety actuator pin 106 eccentrically carried on a wheel 107 having an axis of rotation 108. The wheel has a shaft connected to gearing in gearbox 108, and such gearing is powered by electric motor 110, energized by motor battery 111. Electronic circuitry 112, controlled and directs motor 110 to turn wheel 107 so that safety actuator is moved to its extended safety ON position and to its retracted OFF position as indicated at 134, FIG. 26.

Revolver 1 main spring 113 is connected to hammer 114 which is configured not to contact firing pin 115 due to gap at 116 so that the revolver is prevented from firing. The transfer bar actuator 118 is connected at 119 to the safety 103, both of which pivot about the axis of a fixed pivot 120, operatively connected to the handle. The transfer bar 117 is connected to the transfer bar actuator 118 at pivot 121 which retracts the lower portion of the transfer bar 117 to alignment 122 connecting pivots 120 and 121, or extends transfer bar 117 to alignment 123. When transfer bar 117 is at alignment 122, its transfer 117' is held in position by surface 124 of hammer 114 and surface 125 of the gun 1.

The trigger lock bar 101 is connected to trigger 126 at pivot 127. Trigger 126 is in uncocked forward position as indicated by forward alignment indicated by broken line 128 between pivot 127, and trigger pivot 129. Trigger lock 102 blocks rearward movement of trigger lock bar 101 connected to trigger 126, at 130. Also the trigger 126 cannot be pulled to broken line position 131. The hammer 114 cannot be cocked as at FIG. 27 and 28 because a flange on trigger assembly 34' of FIG. 2, overlaps hammer flange 23 at 39' of FIG. 2. If safety 103 is moved to its retracted position at 150, FIG. 28, its pivot 127 and trigger pivot 129, thus allowing the trigger 126 to be pulled to position 131 so that the revolver can be fired.

Figure 26:
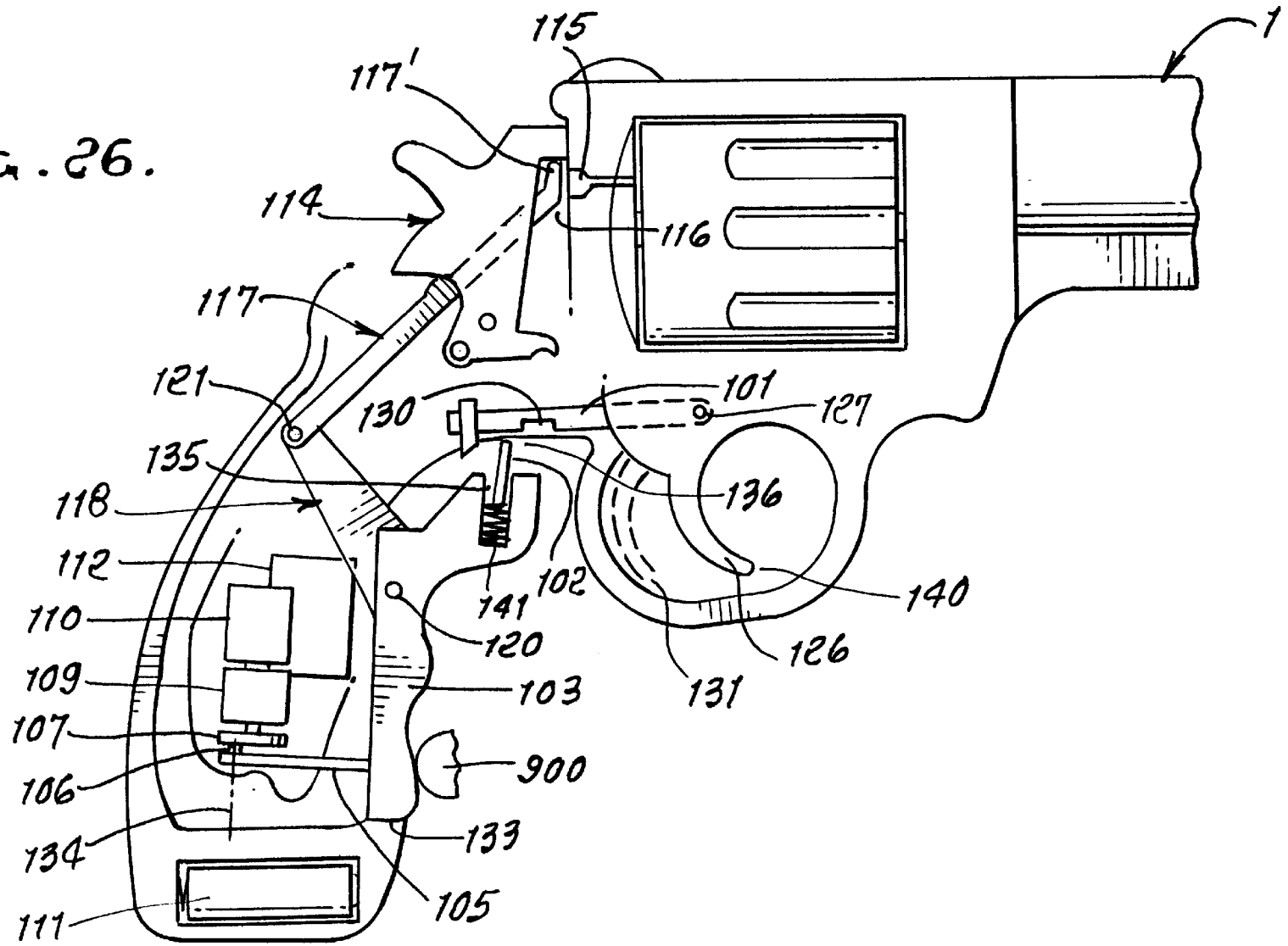

FIG. 26 is a partial right side view of the revolver 1 as depicted in FIG. 25. However, the safety 103 is retracted at 133 when compared to its extended position 104, and the trigger 126 can be pulled to position as indicated by dashed line 131 and the revolver can be fired. The electronic circuitry 112 has been programmed to receive input from the push buttons 9, FIG. 1, directing the motor 100 to rotate wheel 107, 180 degrees through the gear 109, resulting in the safety activator pin 106 at position 134 moving the safety actuator 105 inward so that the safety 103 is retracted at 133. Safety 103 and transfer bar actuator 118 have rotated at safety pivots 120 and 121, pushing transfer 117' on transfer bar 117 up to span gap 116 between hammer 114 and firing pin 115 so that the hammer 114 strikes the transfer 117' which transfers the blow to the firing pin 115.

Trigger lock 102 which rides in hole 135 in safety 103 has moved to position 136 so as not to connect to trigger lock bar 101 at 130, which allows trigger to move into position as indicated at dashed lines 131.

Safety 103 is in its retracted safety OFF position 133 because it is being held there by a user's hand (see finger 900). The microprocessor 110' has been programmed to direct or operate motor 110 to move safety 103 from its retracted safety OFF position 133, when the safety is released by user, to its extended, safety ON position 104 whether or not the gun is in its timed safety mode. While the gun is in its time safety OFF mode, the safety can be moved from safety OFF position at 133 to safety ON position at 104 by the motor 100 which will rotate the wheel 107 and safety actuator pin 106 180°. When a user's hand applies pressure to safety (see finger 801, FIG. 25) and electronic circuitry 112 has received enabling input from user, or safety 103 is in timed safety OFF position at 104, motor 100 will rotate the wheel 107 and safety actuator pin 106 180° to safety OFF position 133.

FIG. 26 depicts the revolver 1 of FIG. 1 wherein the safety 102 has been retracted at 130 and the revolver trigger 126 is not prevented by the trigger lock 102 from allowing trigger lock bar 101 moving to the position as indicated by dashed lines 132, FIG. 25. Trigger lock bar can pass over the trigger lock 102 at 136. Also, the cocking of the hammer, shown in FIG. 28 in preparation for the gun firing, is allowed, as the trigger 126 and trigger bar 101 are not locked by the trigger lock 102 at 130.

Figure 27:
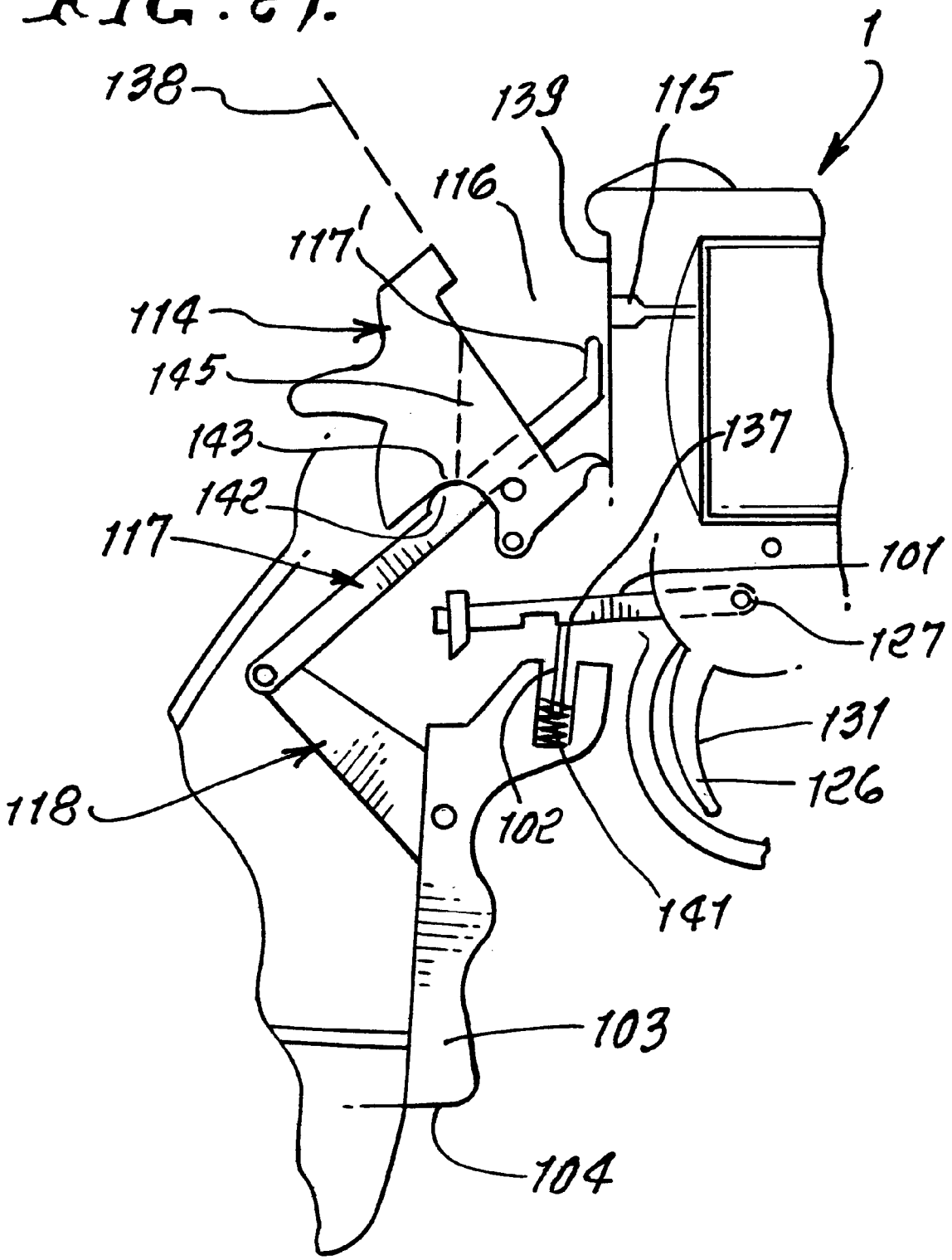

FIG. 27 is a partial right hand view of revolver of FIGS. 1, 25, and 26. If safety 102 is retracted as at 137, then the hammer 114 is cocked as shown at dashed lines 138 which also places the trigger 126 at position 131, and then the safety 103 is returned to its extended safety ON position seen at 104 and the trigger safety bar 101 is at position 132, FIG. 25, it cannot be blocked by trigger lock 102 at 137 which is intentionally prevented from locking the trigger safety bar and trigger 126. The transfer bar 117 is at its retracted, safety ON alignment 122, FIG. 25, so as not to transfer hammer 114 strike through the transfer 117'to the firing pin 24.

If the trigger 126 is pulled, the hammer will fall harmlessly to strike the gun 1 frame at 139 missing the firing pin 115 due to gap 116, and the trigger 126 would then be manually released and move to its forward position at 140, FIG. 25. The trigger safety bar 101 would move right to alignment 128 as at FIG. 25, releasing the trigger lock spring 141, to move the trigger lock 102 to again lock the trigger lock bar 101 as at 130, FIG. 25.

Transfer bar 117 has flange 142 which contacts edge of hammer at 143 which prevents transfer 117' from moving in to gap 116 when safety 103 is in its safety ON position at 104. Transfer bar 117 may pass through slot 145 in hammer 114, or on either side of hammer 114.

Figure 28:
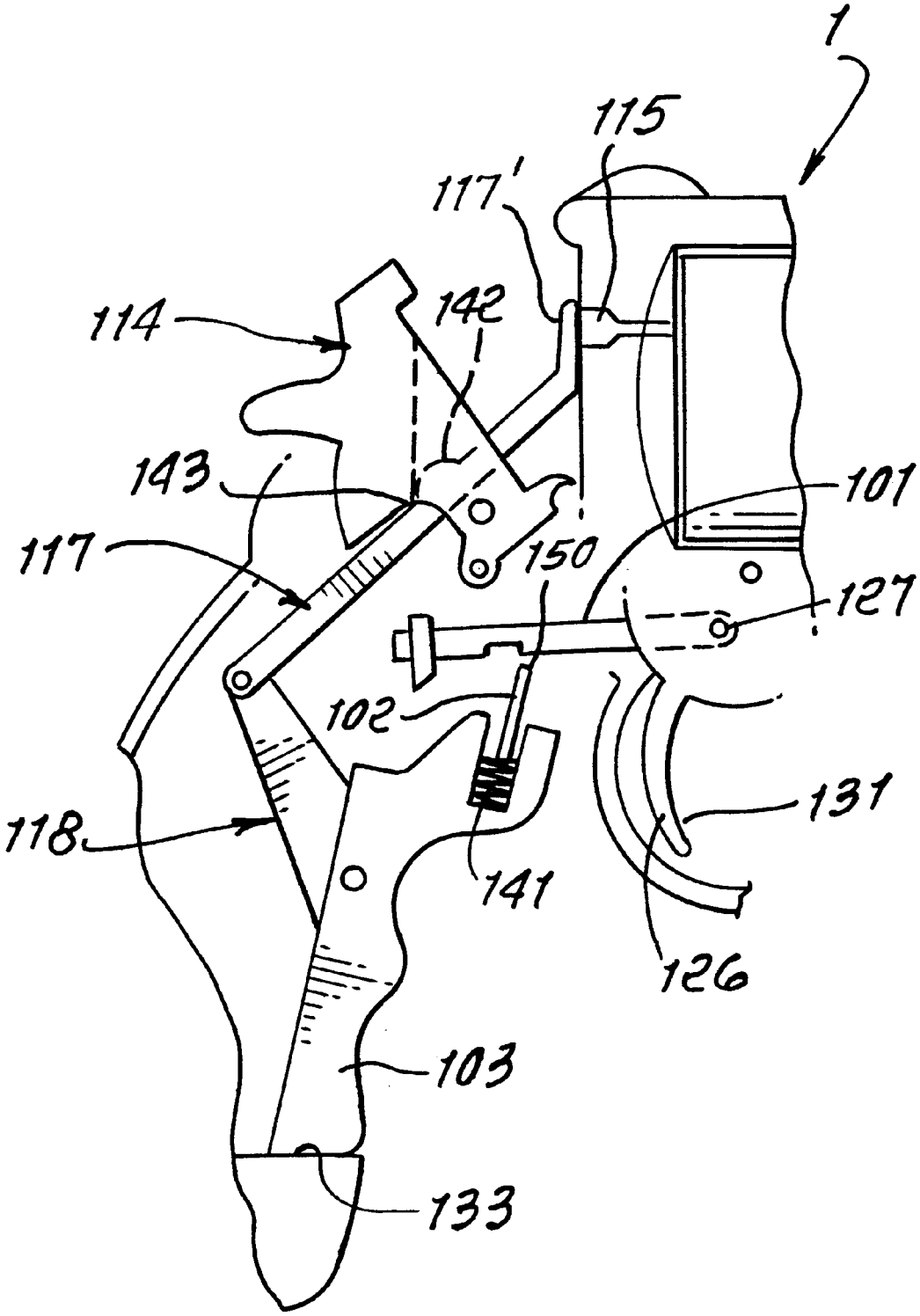

FIG. 28 is a partial cut away left side view of revolver of FIGS. 1, 25, 26 and 27, safety 103 like at FIG. 26 being in retracted safety OFF position at 133. Transfer 117' is in gap 116 like at FIG. 26. If trigger 126 at position 131 is pulled, hammer 114 will fall, strike transfer 117' which will transfer strike to firing pin 115. If safety 103 is then released transfer bar 117 and transfer 117' will be forced down out of gap 116 by transfer bar flange 142, which would ride down over contact point with hammer at 143. Transfer bar 117 returns to alignment 122, as at FIG. 25.

From the above, it will be seen that each of the described guns include the following, in combination:

a) gun firing mechanism, b) an electrically energizable motor or solenoid, c) at least one element operatively connected between the motor and firing mechanism and movable by the motor to inhibit operation of the firing mechanism, and d) and user programmable circuitry carried by the gun and operatively connected to the motor to control motor effected movement of said at least one element.

Further, a safety which is hand grippable may be employed to control the circuitry. Said safety extends from and retracts into the gun sufficiently to inform the user by feel if the gun's safety is ON or OFF. As an alternative to a hand grippable safety, the gun has or may have, at least, a safety status indicator to inform the user by feel and/or sight if the gun's safety is ON or OFF.

A timer may be carried by the gun to additionally control timing of electronic circuitry operation, to control the movement of said one element.

I claim:

1. In a gun, the combination comprising:

a) gun firing mechanism, b) an electrically energizable motor, c) at least one element including a motor rotated shaft operatively connected between the motor and firing mechanism and movable by the motor to alternately enable and inhibit operation of the firing mechanism, d) user programmable circuitry carried by the firearm and operatively connected to the motor to control motor effected movement of said at least one element, e) said programmable circuitry carried by the firearm and operatively connected to the motor to control said motor and shaft effected blocking action.

2. The combination of claim 1 wherein said motor is controlled by the circuitry to move said at least one element.

3. The method of operating a firearm having a grip, and having safety mechanism characterized as having engaged and disengaged states, the safety mechanism including a manually operable safety, there being safety circuitry operatively connected to said safety mechanism and having alternately enabled and disabled states, the steps that include a) allowing the safety mechanism to become engaged while the grip is not being gripped by the user's hand, b) manually gripping the grip, by use of the user's hand, c) enabling the safety circuitry by input from the user's hand, d) operating the manual safety by use of the user's hand, whereby the firearm is enabled to be fired, e) after firing of the firearm, manually releasing the firearm grip, f) allowing switching of the manual safety to engaged (ON) state, whereby the firearm cannot be fired without repeating steps a) through e), g) and wherein no input is provided to the safety mechanism or to the safety circuitry other than from the user's hand or hands.

4. The method of claim 3 including locating said manual safety whereby operation of said manual safety by the user's hand is required before the firearm is enabled to be fired.

5. The method of operating a firearm having a grip, and having safety mechanism characterized as having engaged and disengaged states, the safety mechanism including a timing device and a manually operable safety, there being safety circuitry operatively connected to said safety mechanism and having alternately enabled and disabled states, the steps that include a) allowing the safety mechanism to become engaged which engages said manual safety, if not previously engaged, while the grip is not being gripped by the user's hand, b) manually gripping the grip, by use of the user's hand, c) enabling the safety circuitry by input from the user's hand, whereby the safety mechanism is caused to release said manual safety, d) operating the manual safety by use of the user's hand, whereby the firearm is selectively enabled to be fired, e) after firing of the firearm, manually releasing the firearm grip, f) allowing switching of the manual safety to engaged (ON) state, whereby the firearm cannot be fired without repeating steps a) through e), g) and wherein no input is provided to the safety mechanism or to the safety circuitry other than from the user's hand or hands.

6. The method of operating a firearm having safety mechanism characterized as having engaged and disengaged states, the safety mechanism including a timing device, there being safety circuitry operatively connected to said safety mechanism and having alternately enabled and disabled states, the steps that include a) enabling inputs from the user's hand, whereby the safety mechanism is disengaged for a period of time, b) after firing of the firearm, terminating said period of time by input or inputs from the user's hand, thereby allowing the safety mechanism to engage, whereby the firearm cannot be fired, c) and wherein no input is provided to the safety mechanism or to the safety circuitry other than from the user's hand.

7. The method of operating a firearm having a hand grip, and having safety mechanism characterized as having engaged and disengaged states, a portion of said safety mechanism being sensitive to hand pressure gripping said grip, there being safety circuitry operatively connected to said safety mechanism, and having alternately enabled and disabled states, the steps that include a) allowing the safety mechanism to become engaged while the grip is not being gripped by the user's hand, b) the firearm having a status indicator indicating the safety mechanism is engaged, c) manually gripping the firearm, by use of the user's gun holding hand, d) enabling the safety circuitry by input from the user's gun holding hand, e) manually gripping the grip by the use of the user's gun holding hand, f) the firearm's status indicator indicating the safety is not engaged, g) after firing of the firearm, manually releasing the firearm's grip, h) the firearms' status indicator indicating the safety mechanism is engaged, i) and wherein no input is provided to the safety actuator or to the safety circuitry other than from the user's hand or hands.

8. The method of claim 7 including providing a push button combination lock associated with said grip.

9. The method of claim 8 wherein the lock includes multiple push buttons, and including allowing multiple of said buttons to be pushed simultaneously to achieve a greater number of alpha numeric combinations.

10. The method of claim 7 wherein said firearm is a revolver including a trigger and a hammer movable in response to trigger movement to fire the revolver, and also comprising a hammer block having a first position in which hammer movement is unblocked, and a second position in which hammer movement is blocked, and a hammer block actuator to actuate the hammer block between said first and second positions, and a safety device to control said actuator.

11. The method of claim 7 wherein said firearm is a revolver including a trigger and a hammer movable in response to trigger movement to fire the revolver, and also comprising a hammer block having a first position in which hammer movement is unblocked, and a second position in which hammer movement is blocked, a hammer block actuator to actuate the hammer block between said first and second positions, and means to control said actuator.

* * * * *